US009201351B2

(12) United States Patent
Yuasa

(10) Patent No.: US 9,201,351 B2
(45) Date of Patent: Dec. 1, 2015

(54) IMAGE FORMING APPARATUS

(71) Applicant: CANON KABUSHIKI KAISHA, Tokyo (JP)

(72) Inventor: Takao Yuasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/468,596

(22) Filed: Aug. 26, 2014

(65) Prior Publication Data

US 2015/0063879 A1 Mar. 5, 2015

(30) Foreign Application Priority Data

Sep. 3, 2013 (JP) ..... 2013-182009

(51) Int. Cl.
*G03G 15/01* (2006.01)
*G03G 15/16* (2006.01)
*G03G 21/00* (2006.01)

(52) U.S. Cl.
CPC ..... *G03G 15/1615* (2013.01); *G03G 15/0136* (2013.01); *G03G 15/0189* (2013.01); *G03G 21/0094* (2013.01); *G03G 2215/0132* (2013.01)

(58) Field of Classification Search
USPC ..... 399/38, 66, 297–302
See application file for complete search history.

(56) References Cited

U.S. PATENT DOCUMENTS

2007/0286628 A1* 12/2007 Kayahara et al. ..... 399/66
2009/0245869 A1* 10/2009 Nieda ..... 399/167
2009/0252517 A1* 10/2009 Tachiki et al. ..... 399/66
2011/0249992 A1* 10/2011 Yoshida ..... 399/299

FOREIGN PATENT DOCUMENTS

JP 2001-083758 A 3/2001
JP 2003-186313 A 7/2003
JP 2007-212934 A 8/2007

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a contact-separation mechanism configured to change over from a fully separated position in which an intermediate transfer member is separated from first and second image bearing members to a partly contacted position in which the intermediate transfer member is separated from the first image bearing member in contact with the second image bearing member to a fully contacted position in which the intermediate transfer member is in contact with the first and the second image bearing members; and a control portion configured to rotationally drive the first image bearing member when the contact-separation mechanism passes through the fully contacted position in association with an image formation for forming a toner image by only the second image bearing member in the partly contacted position.

20 Claims, 13 Drawing Sheets

IMAGE FORMING APPARATUS

BACKGROUND OF THE INVENTION

1. Field of the Invention

The present invention relates to an image forming apparatus such as a copying machine, a printer, a facsimile machine, and a multifunction peripheral including a plurality of functions of those described above.

2. Description of the Related Art

Hitherto, as a full-color image forming apparatus, there is known a so-called tandem configuration in which a plurality of photosensitive drums serving as image bearing members are located alongside an intermediate transfer belt serving as an intermediate transfer member. Further, hitherto, this configuration is also known for such operation that, at a time of monochrome image formation for forming an image only in black, photosensitive drums for the other colors are separated from the intermediate transfer belt, and at a time of forming no image, all the photosensitive drums are separated from the intermediate transfer belt. In addition, Japanese Patent Application Laid-Open No. 2007-212934 proposes a technology for changing, with a simple configuration, the positions of the photosensitive drums among positions at the time of the monochrome image formation, positions at the time when all the photosensitive drums are brought into contact with the intermediate transfer belt to form an image in full color, and positions at the time of forming no image.

By the way, in recent years, for the sake of lower cost, it has been demanded to reduce the number of motors serving as a drive source configured to drive the intermediate transfer belt and so on. Here, it is conceivable to provide a configuration in which a common motor is used to rotate the intermediate transfer belt and to drive a contact-separation mechanism configured to change over a contact-separation state of the photosensitive drums and the intermediate transfer belt among the positions at the time of the monochrome image formation, the positions at the time of the full-color image formation, and the positions at the time of forming no image. In this case, the motor can be driven only in one direction in order to rotate the intermediate transfer belt as well. In other words, when the intermediate transfer belt is rotated in a reverse direction, it is necessary to reversely rotate the photosensitive drums in contact with the intermediate transfer belt at the same time. At this time, there is a fear that toner or the like accumulated on a cleaning blade configured to clean toner or the like in contact with the photosensitive drum may be dragged on the photosensitive drum due to the reverse rotation of the photosensitive drum, with the result that a charging device, a developing device, and so on arranged around the photosensitive drum is stained. Therefore, the motor can be driven only in one direction, and the contact-separation mechanism changes the contact-separation state among the above-mentioned positions in order while the motor is driven in one direction.

In such a configuration configured to change over the contact-separation state of the photosensitive drums and the intermediate transfer belt among the respective positions in order, when the contact-separation state is changed over at a time of performing or completing the monochrome image formation, the photosensitive drums are once changed over to the positions at the time of the full-color image formation. In general, at the time of the monochrome image formation, the driving of the color photosensitive drums other than the one for black is stopped. In contrast, the intermediate transfer belt is in a rotating state because the motor is being driven in order to change over the contact-separation mechanism. Accordingly, when the photosensitive drums are once changed over to the positions at the time of the full-color image formation, the stopped color photosensitive drums and the rotating intermediate transfer belt rub each other. Such rubbing may cause a flaw in the photosensitive drums and the intermediate transfer belt, thereby causing an image failure such as a streaked image.

SUMMARY OF THE INVENTION

In view of the above-mentioned circumstances, the present invention has been made in order to suppress rubbing between an image bearing member and an intermediate transfer member with a configuration in which a common drive source is used to rotate the intermediate transfer member and to drive a contact-separation mechanism configured to change a positional relationship of the image bearing member and the intermediate transfer member.

According to one embodiment of the present invention, there is provided an image forming apparatus, comprising:

a first image bearing member to be rotationally driven;

a second image bearing member to be rotationally driven;

a first toner image forming portion configured to form a toner image on the first image bearing member;

a second toner image forming portion configured to form a toner image on the second image bearing member;

an intermediate transfer member arranged so as to be brought into contact with and separated from the first image bearing member and the second image bearing member, the intermediate transfer member being configured so that the toner image formed on the first image bearing member and the toner image formed on the second image bearing member are transferred onto the intermediate transfer member;

a drive source to be driven in a predetermined direction in order to drive the intermediate transfer member;

a contact-separation mechanism configured to change over, by a driving of the drive source in the predetermined direction, from a fully separated position in which the intermediate transfer member is separated from the first image bearing member and the second image bearing member to a partly contacted position in which the intermediate transfer member is separated from the first image bearing member and is in contact with the second image bearing member to a fully contacted position in which the intermediate transfer member is in contact with the first image bearing member and the second image bearing member in order, or from the fully separated position to the fully contacted position to the partly contacted position in order;

a connection-disconnection device configured to connect and disconnect a drive transmission from the drive source to the contact-separation mechanism; and a control portion configured to change over to the fully contacted position when a first mode for forming the toner image by the first image bearing member and the second image bearing member is performed, and change over to the partly contacted position when a second mode for forming the toner image by only the second image bearing member is performed, the control portion configured to rotationally drive the first image bearing member when the contact-separation mechanism passes through the fully contacted position in association with a performance of the second mode.

Further features of the present invention will become apparent from the following description of exemplary embodiments with reference to the attached drawings.

DESCRIPTION OF THE EMBODIMENTS

Figure 1:
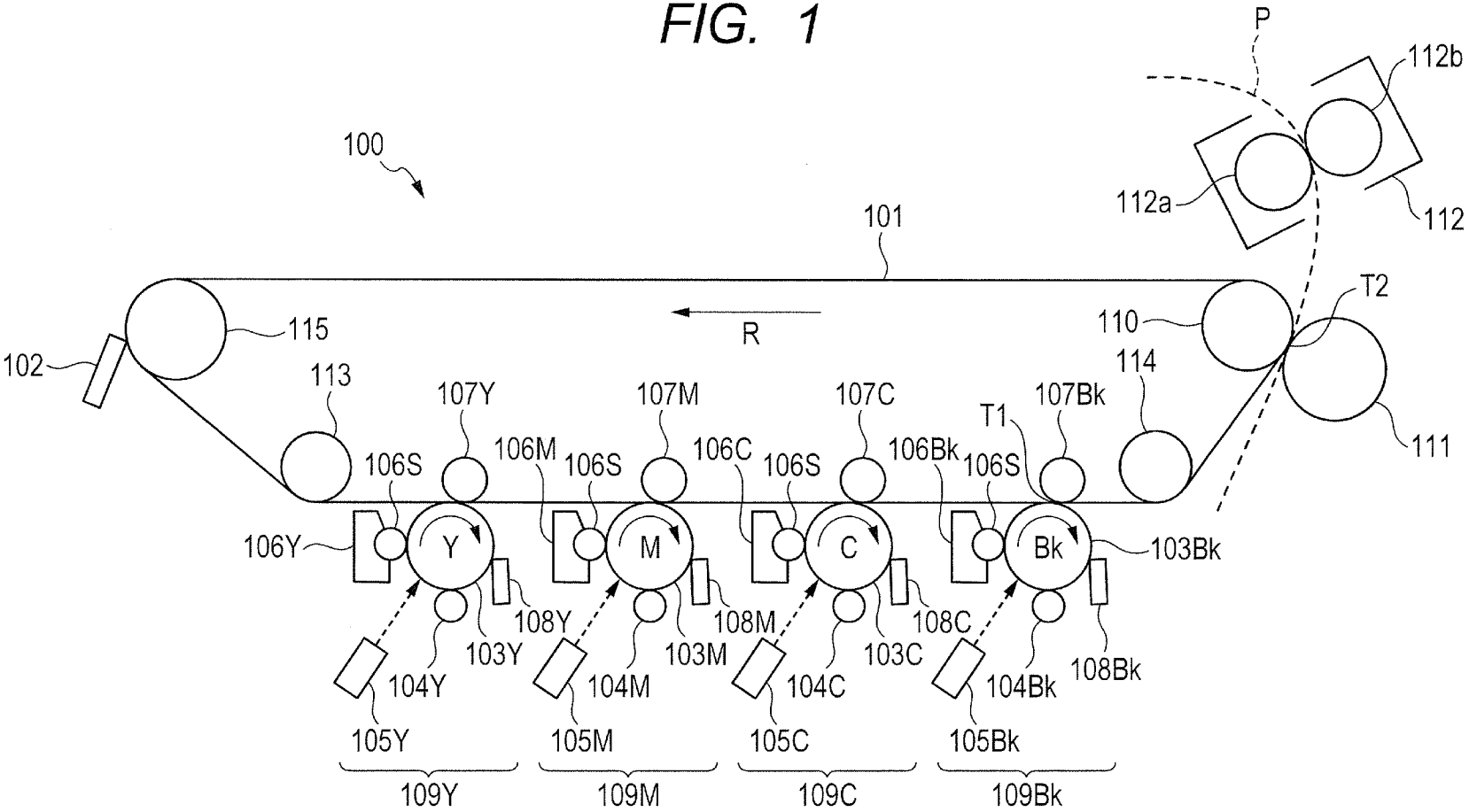
FIG. 1 is a schematic configuration diagram of an image forming apparatus according to a first embodiment of the present invention.

Preferred embodiments of the present invention will now be described in detail in accordance with the accompanying drawings.

<First Embodiment>

A first embodiment of the present invention will be described with reference to FIG. 1 to FIGS. 6A and 6B. First, a schematic configuration of an image forming apparatus according to the embodiment will be described with reference to FIG. 1.

[Image Forming Apparatus]

An image forming apparatus 100 is a full-color printer of a tandem intermediate transfer system in which yellow, magenta, cyan, and black image forming portions 109Y, 109M, 109C, and 109Bk, respectively, are disposed alongside an intermediate transfer belt (ITB) 101 serving as an intermediate transfer member.

In the image forming portion 109Y, a yellow toner image is formed on a photosensitive drum 103Y serving as a first image bearing member and transferred onto the intermediate transfer belt 101. In the image forming portion 109M, a magenta toner image is formed on a photosensitive drum 103M serving as another first image bearing member and transferred onto the intermediate transfer belt 101. In the image forming portion 109C, a cyan toner image is formed on a photosensitive drum 103C serving as still another first image bearing member and transferred onto the intermediate transfer belt 101. In the image forming portion 109Bk, a black toner image is formed on a photosensitive drum 103Bk serving as a second image bearing member and transferred onto the intermediate transfer belt 101. Those toner images of the respective colors are transferred in order onto the intermediate transfer belt 101 so as to be superimposed one on another, to thereby form and bear a full-color toner image on the intermediate transfer belt 101.

Further, in the case of the embodiment, a full-color mode serving as a first mode and a monochrome mode serving as a second mode are allowed to be performed. In the full-color mode, as described above, toner images are formed by all image forming portions, in other words, the toner images are formed by the photosensitive drums 103Y, 103M, and 103C serving as the first image bearing members and the photosensitive drum 103Bk serving as the second image bearing member. On the other hand, in the monochrome mode, a toner image is formed by only the photosensitive drum 103Bk serving as the second image bearing member. Then, the full-color toner image formed in the full-color mode and a monochrome toner image formed in the monochrome mode are each transferred onto the intermediate transfer belt 101.

The full-color toner image or the monochrome toner image transferred onto the intermediate transfer belt 101 is borne and conveyed to a secondary transfer portion T2 by the intermediate transfer belt 101, and secondarily transferred onto a recording material P collectively. The recording material P onto which the toner image has been secondarily transferred is self-stripped from the intermediate transfer belt 101, and then sent into a fixing device 112. The fixing device 112 uses a fixing roller 112*a* and a pressure roller 112*b* to heat and pressurize the recording material P, fuse the toner, and fix the image onto a surface of the recording material P. After that, the recording material P is delivered to an outside of a machine body.

Next, a specific configuration of each portion will be described. Note that, the image forming portions 109Y, 109M, 109C, and 109Bk are configured in substantially the same manner except that toner used in respective developing devices thereof have different colors of yellow, magenta, cyan, and black, respectively. Therefore, in the following, a toner image forming process performed by the image forming portion will be described by adding suffixes Y, M, C, and Bk indicating components of the image forming portion for the respective colors as necessary and omitting the suffixes otherwise.

Around the photosensitive drum 103, a charging roller 104 serving as a charging unit (charging member), an exposure device 105, a developing device 106, a primary transfer roller 107 serving as a primary transfer member, and a drum cleaning blade 108 serving as a cleaning unit (cleaning device) are arranged. In the embodiment, the charging rollers 104Y, 104M, and 104C, the exposure devices 105Y, 105M, and 105C, and the developing devices 106Y, 106M, and 106C of the image forming portions 109Y, 109M, and 109C, respectively, each correspond to a first toner image forming unit (first toner image forming portion). On the other hand, the charging roller 104Bk, the exposure device 105Bk, and the developing device 106Bk of the image forming portion 109Bk each correspond to a second toner image forming unit (second toner image forming portion). The first toner image forming unit and the second toner image forming unit form toner images on the respective photosensitive drums 103.

The photosensitive drum 103 has a photosensitive layer whose charging polarity is a negative polarity formed on a surface thereof, and rotates in a direction indicated by the arrow at a predetermined process speed. The charging roller 104 has a DC voltage having a negative polarity applied thereto, and charges a surface of the photosensitive drum 103 to a negative polarity. The exposure device 105 uses a rotating mirror to scan a laser beam, which is obtained by on-off modulating scanning line image data obtained by developing a separated color image of the color corresponding to the image forming portion, and writes an electrostatic image of the image on the surface of the photosensitive drum 103.

The developing device 106 triboelectrically charges a two-component developer including a magnetic carrier and non-magnetic toner whose charging polarity is a negative polarity, and causes the two-component developer to be carried on a developing sleeve 106S, to convey the two-component developer to a portion opposed to the photosensitive drum 103. When an oscillation voltage obtained by superimposing an AC voltage on a DC voltage having a negative polarity is applied to the developing sleeve 106S, the toner charged to the negative polarity is transferred to an exposed part of the photosensitive drum 103 charged to a relatively positive polarity, with the result that the electrostatic image is reversely developed.

The primary transfer roller 107 forms a primary transfer portion T1 between the photosensitive drum 103 and the intermediate transfer belt 101. When the DC voltage having a positive polarity is applied to the primary transfer roller 107, the toner image borne on the photosensitive drum 103 is primarily transferred onto the intermediate transfer belt 101. The drum cleaning blade 108 is formed of an elastic member, and rubs the surface of the photosensitive drum 103 so as to be opposed to a rotational direction of the photosensitive drum 103, to thereby clean transfer residual toner or the like remaining on the surface of the photosensitive drum 103. Further, the primary transfer roller 107 moves in a direction for moving away from and near to the photosensitive drum 103 by a contact-separation mechanism 203 described later, and is brought into contact with or separated from the photosensitive drum 103 through intermediation of the intermediate transfer belt 101.

The intermediate transfer belt 101 is arranged so as to be able to be brought into contact with or separated from the photosensitive drums 103Y, 103M, 103C, and 103Bk, and the toner images formed on the respective photosensitive drums 103 are transferred thereonto as described above. The intermediate transfer belt 101 is an endless belt member, and is looped around a drive roller 110 serving as a drive member, suspension rollers 113 and 114 serving as suspension members, and a tension roller 115 configured to apply a predetermined tensile force to the intermediate transfer belt 101. Further, the intermediate transfer belt 101 is driven for conveyance (rotated) in a direction indicated by the arrow R by the drive roller 110. The drive roller 110 also functions as an inner roller for secondary transfer arranged at the secondary transfer portion T2. However, the number of rollers around which the intermediate transfer belt 101 is passed is not limited to that of the configuration of FIG. 1.

A secondary transfer roller 111 serving as a secondary transfer member is brought into contact with an outer surface of the intermediate transfer belt 101 between the image forming portion 109Bk and a belt cleaning blade 102 in a direction for conveying the toner image. The secondary transfer roller 111 is brought into contact with the intermediate transfer belt 101 whose inner surface is supported by the drive roller 110 opposed to the secondary transfer roller 111, to form the secondary transfer portion T2. When the DC voltage having a positive polarity is applied to the secondary transfer roller 111, the toner image borne on the intermediate transfer belt 101 is secondarily transferred onto the recording material P. The belt cleaning blade 102 is arranged in a position opposed to the tension roller 115, and rubs a surface of the intermediate transfer belt 101 so as to be opposed to a rotational direction of the intermediate transfer belt 101, to thereby clean the transfer residual toner or the like remaining on the surface of the intermediate transfer belt 101.

[Drive Configuration]

Next, a configuration configured to drive the respective photosensitive drums 103Y, 103M, 103C, and 103Bk, the intermediate transfer belt 101, and the contact-separation mechanism 203 described above will be described with reference to FIG. 2A. Note that, the contact-separation mechanism 203, which will be described later in detail, is a mechanism configured to bring the intermediate transfer belt 101 into contact with the respective photosensitive drums 103Y, 103M, 103C, and 103Bk and separate the intermediate transfer belt 101 from the respective photosensitive drums 103Y, 103M, 103C, and 103Bk.

Figure 2A:
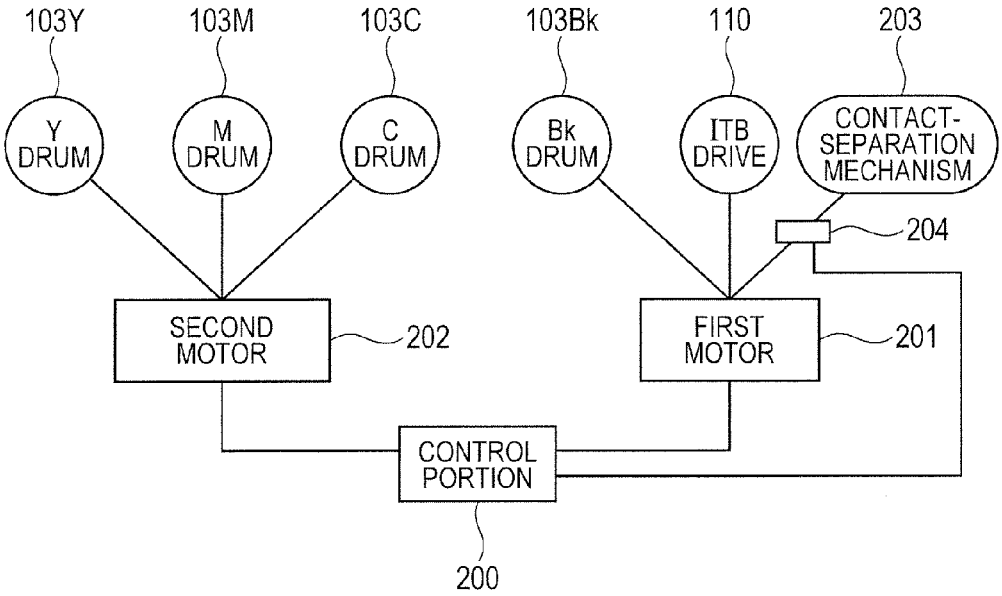
FIG. 2A is a schematic diagram illustrating respective drive configurations of photosensitive drums, an intermediate transfer belt, and a contact-separation mechanism according to the first embodiment.

In the embodiment, the rotation of the intermediate transfer belt 101 and the driving of the contact-separation mechanism 203 are performed in common by a first motor 201 serving as a drive source. In other words, power of the first motor 201 is transmitted to the drive roller 110 (ITB drive) configured to rotationally drive the intermediate transfer belt 101 and the contact-separation mechanism 203. The first motor 201 can be driven in a predetermined direction in order to drive the intermediate transfer belt 101, and the contact-separation mechanism 203 changes over a positional relationship of the intermediate transfer belt 101 and the respective photosensitive drums when the first motor 201 is driven in the predetermined direction. Particularly in the embodiment, as illustrated in FIG. 2A, the photosensitive drum 103Bk (Bk drum) serving as the second image bearing member is also rotationally driven by the first motor 201.

Further, a clutch 204 serving as a connection-disconnection unit (connection-disconnection device) configured to connect and disconnect a drive transmission from the first motor 201 to the contact-separation mechanism 203 is provided between the first motor 201 and the contact-separation mechanism 203. When the contact-separation mechanism 203 is driven, the clutch 204 can connect the power of the first motor 201 to the contact-separation mechanism 203. With this configuration, by disconnecting power transmission with use of the clutch 204 at a time of image formation, it is possible to drive the photosensitive drum 103Bk and the intermediate transfer belt 101 without driving the contact-separation mechanism 203 even when the first motor 201 is driven.

In contrast, when there is need to change a position of the intermediate transfer belt 101, by connecting the power by use of the clutch 204, it is possible to drive the contact-separation mechanism 203 by use of the first motor 201. In this case, the photosensitive drum 103Bk and the intermediate transfer belt 101 are also rotationally driven. Note that, the photosensitive drum 103Bk and the drive roller 110 of the intermediate transfer belt 101 may be driven by separate motors, respectively.

In the embodiment, the driving of the contact-separation mechanism 203 and the rotation of the intermediate transfer belt 101 are thus performed by the common first motor 201. Therefore, as described above, the first motor 201 can be driven in a predetermined direction (one direction) for rotationally driving the intermediate transfer belt 101 at the time of the image formation. Accordingly, the contact-separation mechanism 203 is also rotationally driven in one direction at all times.

On the other hand, the photosensitive drums 103Y (Y drum), 103M (M drum), and 103C (C drum) serving as the first image bearing members are rotationally driven in common by a second motor 202. Those respective photosensitive drums 103Y, 103M, and 103C may be driven by separate motors, respectively, but it is possible to reduce the number of motors by driving the photosensitive drums 103Y, 103M, and 103C in common. Further, the respective photosensitive drums 103Y, 103M, and 103C can be rotationally driven by the above-mentioned first motor 201, and a clutch may be provided between the respective photosensitive drums 103Y, 103M, and 103C and the first motor 201. In any case, it suffices that the respective photosensitive drums 103Y, 103M, and 103C be rotationally driven independently of the photosensitive drum 103Bk and of the intermediate transfer belt 101. The first motor 201, the second motor 202, and the clutch 204 are each controlled by a control portion 200 serving as a control unit.

Figure 2B:
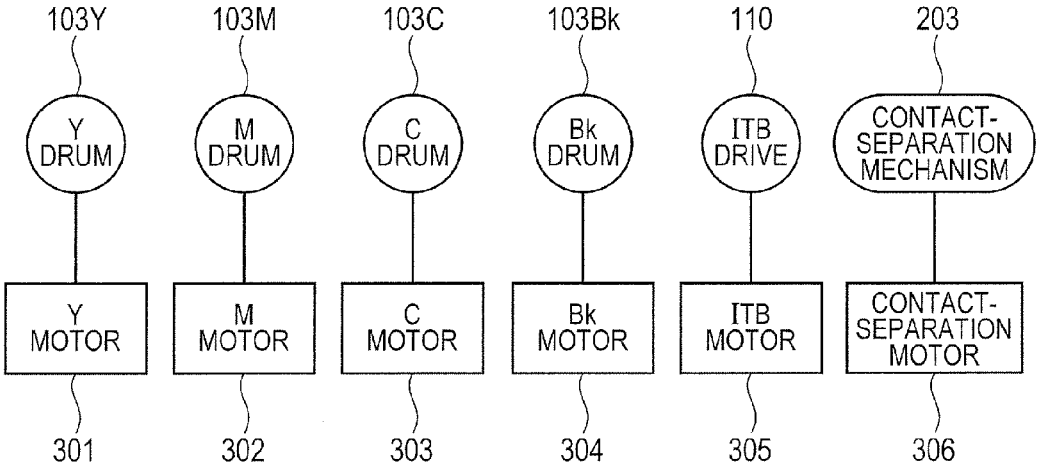
FIG. 2B is a schematic diagram illustrating respective drive configurations of photosensitive drums, an intermediate transfer belt, and a contact-separation mechanism according to a comparative example.

FIG. 2B illustrates a comparative example in which the above-mentioned respective photosensitive drums 103Y, 103M, 103C, and 103Bk, the drive roller 110 of the intermediate transfer belt 101, and the contact-separation mechanism 203 are driven by separate motors 301, 302, 303, 304, 305, and 306, respectively. As apparent from a comparison between FIG. 2A and FIG. 2B, in the case of the embodiment, it is possible to achieve lower cost of the image forming apparatus 100 because the number of motors can be reduced to two from six used in the comparative example.

[Contact-separation Mechanism]

Figure 3:
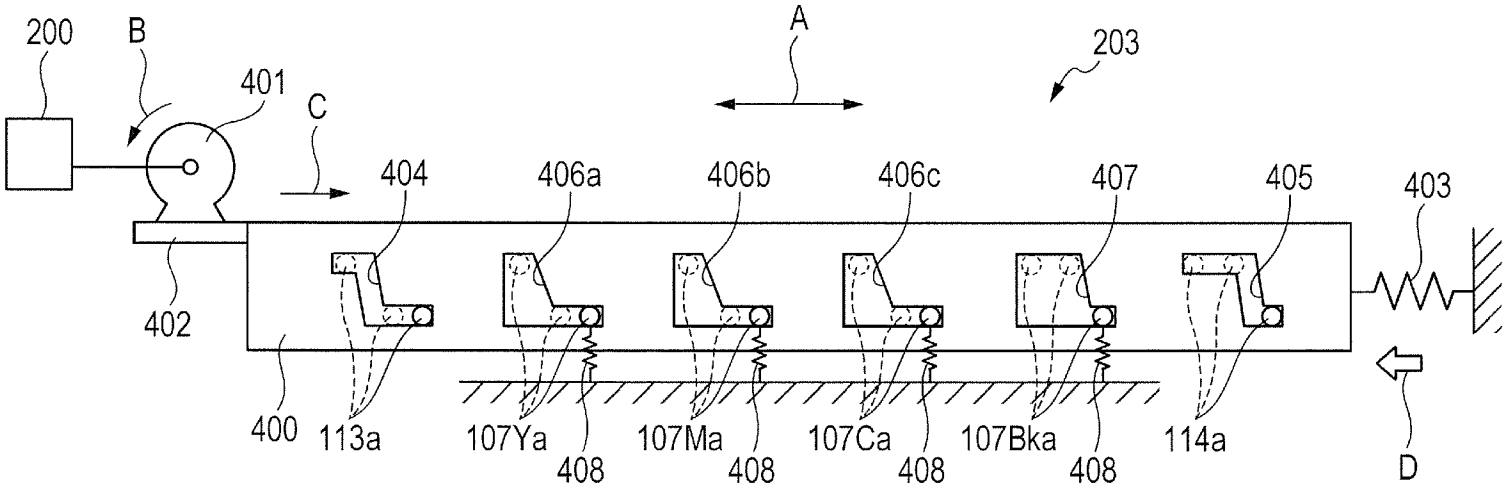
FIG. 3 is a schematic diagram of the contact-separation mechanism according to the first embodiment.

Next, an example of a specific configuration of the above-mentioned contact-separation mechanism 203 will be described with reference to FIG. 3. As illustrated in FIG. 3, the contact-separation mechanism 203 includes a separation plate 400, a partly toothless gear 401, a rack 402, and a spring 403. Separation plates 400 are arranged on both end sides of the suspension rollers 113 and 114 of the intermediate transfer belt 101 and the primary transfer rollers 107Y, 107M, 107C, and 107Bk, respectively, and support both end portions of the respective rollers through intermediation of bearings or the like. The pair of separation plates 400 thus arranged on both the end sides of the respective rollers is configured in the same manner and operates in the same manner, and hence one of the separation plates 400 will be described below.

The separation plate 400 is placed along a direction in which the respective photosensitive drums 103Y, 103M, 103C, and 103Bk are arranged so as to be able to reciprocate in the direction indicated by the arrow A along the above-mentioned direction. Further, a plurality of engagement holes 404, 405, 406*a*, 406*b*, 406*c*, and 407 are formed in the separation plate 400. The engagement holes 404 and 405, which are formed in both end portions in a direction along which the separation plate 400 is placed, are engaged with rotary shafts 113*a* and 114*a* of the suspension rollers 113 and 114, respectively, through intermediation of bearings (not shown). Further, the rotary shafts 113*a* and 114*a* are free to move along the engagement holes 404 and 405.

Further, the engagement holes 406*a*, 406*b*, 406*c*, and 407 are engaged with rotary shafts 107Ya, 107Ma, 107Ca, and 107Bka of the primary transfer rollers 107Y, 107M, 107C, and 107Bk, respectively, through intermediation of bearings (not shown). Further, the rotary shafts 107Ya, 107Ma, 107Ca, and 107Bka are free to move along the engagement holes 406*a*, 406*b*, 406*c*, and 407, respectively.

Further, both end portions of the rotary shafts 107Ya, 107Ma, 107Ca, and 107Bka are urged toward the top of FIG. 3 (toward the photosensitive drum 103) through intermediation of the bearings by springs 408. With this configuration, the primary transfer rollers 107Y, 107M, 107C, and 107Bk are urged toward the photosensitive drums 103Y, 103M, 103C, and 103Bk, respectively.

Here, the engagement hole 404 engaged with the rotary shaft 113*a* of the suspension roller 113 has a right end portion to a middle portion of FIG. 3 formed in a position far from the photosensitive drum 103, and has a left end portion of FIG. 3 formed in a position close to photosensitive drum 103. The two positions are continuously connected to each other by an inclined portion. Further, the engagement hole 405 engaged with the rotary shaft 114*a* of the suspension roller 114 has a right end portion of FIG. 3 formed in a position far from the photosensitive drum 103, and has a middle portion to a left end portion of FIG. 3 formed in a position close to photosensitive drum 103. The two positions are continuously connected to each other by an inclined portion.

The engagement holes 404 and 405 have widths slightly larger than diameters of the rotary shafts 113*a* and 114*a*, respectively. Therefore, as the separation plate 400 reciprocates in the direction indicated by the arrow A, the rotary shafts 113*a* and 114*a* move along the engagement holes 404 and 405, respectively, to the positions indicated by the solid lines in the right end portions, the middle portions, and the positions indicated by the broken lines in the left end portions.

Further, the engagement holes 406*a*, 406*b*, and 406*c* engaged with the rotary shafts 107Ya, 107Ma, and 107Ca of the primary transfer rollers 107Y, 107M, and 107C, respectively, are formed in the same manner. Specifically, the engagement holes 406*a*, 406*b*, and 406*c* each have a surface on the side of the photosensitive drum 103 (upper surface) formed as follows. In other words, the engagement holes 406*a*, 406*b*, and 406*c* each have a right end portion to a middle portion of FIG. 3 formed in a position far from the photosensitive drum 103, and a left end portion of FIG. 3 formed in a position close to the photosensitive drum 103. The two positions are continuously connected to each other by an inclined portion. Each engagement hole has a surface on a farther side from the photosensitive drum 103 (lower surface) formed in parallel with the direction indicated by the arrow A.

Further, the engagement hole 407 engaged with the rotary shaft 107Bka of the primary transfer roller 107Bk has a surface on the side of the photosensitive drum 103 (upper surface) formed as follows. In other words, the engagement hole 407 has a right end portion of FIG. 3 formed in a position far from the photosensitive drum 103, and a middle portion to a left end portion of FIG. 3 formed in a position close to the photosensitive drum 103. The two positions are continuously connected to each other by an inclined portion. The engagement hole 407 has a surface on a farther side from the photosensitive drum 103 (lower surface) formed in parallel with the direction indicated by the arrow A.

The respective rotary shafts 107Ya, 107Ma, 107Ca, and 107Bka are urged toward the photosensitive drum 103 by the springs 408 as described above. Therefore, as the separation plate 400 reciprocates in the direction indicated by the arrow A, the rotary shafts 107Ya, 107Ma, 107Ca, and 107Bka move along the upper surfaces of the engagement holes 406*a*, 406*b*, 406*c*, and 407, respectively. In other words, the rotary shafts 107Ya, 107Ma, 107Ca, and 107Bka move to the positions indicated by the solid lines in the right end portions, the middle portions, and the positions indicated by the broken lines in the left end portions.

The partly toothless gear 401 has gear teeth formed only in a part along a circumferential direction thereof, and is rotationally driven by the first motor 201. The rack 402 is fixed to the separation plate 400, and is meshed with the gear teeth of the partly toothless gear 401. When the partly toothless gear 401 is rotated in the direction indicated by the arrow B by the first motor 201, the rack 402 moves due to the mesh with the gear teeth of the partly toothless gear 401, to thereby cause the separation plate 400 to move in the direction indicated by the arrow C. A range of the gear teeth of the partly toothless gear 401 corresponds to a range that allows the separation plate 400 to move to a fully separated position, a partly contacted position, and a fully contacted position, which are described later, in the stated order. In other words, it is possible to repeatedly execute a first operation including a changing operation for changing over the position of the separation plate 400 from the fully separated position to the partly contacted position to the fully contacted position in the stated order in accordance with the rotation of the partly toothless gear 401. When the partly toothless gear 401 is rotated to such a direction that the separation plate 400 moves further past the fully contacted position, a part of the partly toothless gear 401 in which its gear teeth are not formed is opposed to the rack 402.

The spring 403 urges the separation plate 400 in a direction opposite to the direction indicated by the arrow C, that is, in the direction indicated by the arrow D. Note that, the direction indicated by the arrow C and the direction indicated by the arrow D are directions along the above-mentioned direction indicated by the arrow A. When the partly toothless gear 401 is rotated to such a direction that the separation plate 400 moves further past the fully contacted position and thus the part of the partly toothless gear 401 in which its gear teeth are not formed is opposed to the rack 402, the separation plate 400 moves in the direction indicated by the arrow D by being urged by the spring 403. As a result, the separation plate 400 returns to the fully separated position. Subsequently, the gear teeth of the partly toothless gear 401 are meshed with the rack 402, to thereby cause the separation plate 400 to move in the direction indicated by the arrow C again.

In this manner, while the partly toothless gear 401 is rotated in one direction, the separation plate 400 moves in the direction indicated by the arrow C within such a range that the gear teeth are meshed with the rack 402, and moves in the direction indicated by the arrow D when the gear teeth are no longer meshed to let the spring 403 urge the separation plate 400. In other words, the separation plate 400 is caused to reciprocate in the direction indicated by the arrow A. In the embodiment, by configuring the contact-separation mechanism 203 in the above-mentioned manner, the positional relationship of the intermediate transfer belt 101 and the respective photosensitive drums 103 can be changed over to the fully separated position, the partly contacted position, and the fully contacted position in the stated order as described below.

[Description of Fully Separated Position, Partly Contacted Position, and Fully Contacted Position]

As described above, the contact-separation mechanism 203 can change the positions of the suspension rollers 113 and 114, the primary transfer rollers 107Y, 107M, 107C, and 107Bk by reciprocating the separation plate 400 in the direction indicated by the arrow A and guiding each rotary shaft by each engagement hole. Further, the positional relationship of the intermediate transfer belt 101 and the photosensitive drums 103Y, 103M, 103C, and 103Bk can be changed over as illustrated in FIGS. 4A, 4B and 4C.

In other words, in the embodiment, the first motor 201 is controlled by the control portion 200, to thereby drive the contact-separation mechanism 203, thereby allowing the positional relationship of the intermediate transfer belt 101 and the respective photosensitive drums 103 to be changed over to the three positions: the fully separated position, the partly contacted position, and the fully contacted position. The control portion 200 changes over the positional relationship to the fully contacted position when the full-color mode is performed, to the partly contacted position when the monochrome mode is performed, and to the fully separated position serving as a home position when the image forming operation is stopped. As described above, the first motor 201 can be driven only in a predetermined direction, and hence the first motor 201 is driven in the predetermined direction, to thereby drive the contact-separation mechanism 203 in one direction. As a result, as described above, the contact-separation mechanism 203 changes over the positional relationship of the intermediate transfer belt 101 and the photosensitive drums 103Y, 103M, 103C, and 103Bk from the fully separated position to the partly contacted position to the fully contacted position in the stated order.

Figure 4A:
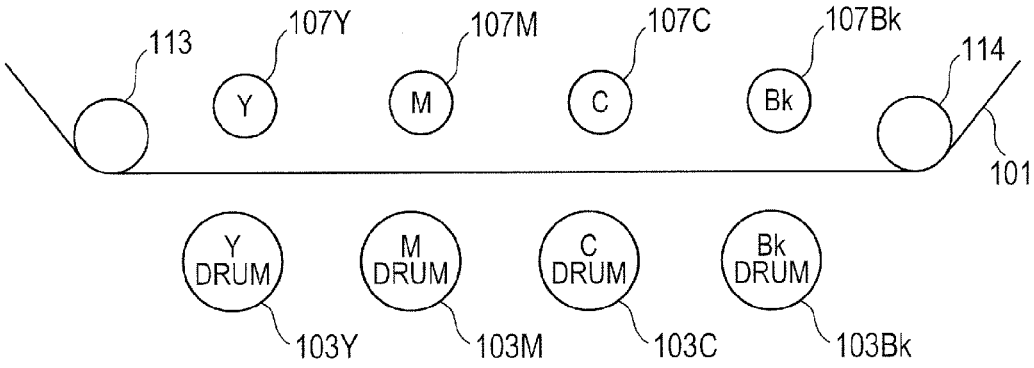
FIG. 4A is a schematic diagram illustrating a positional relationship of the intermediate transfer belt and the respective photosensitive drums in a fully separated position.
Figure 4B:
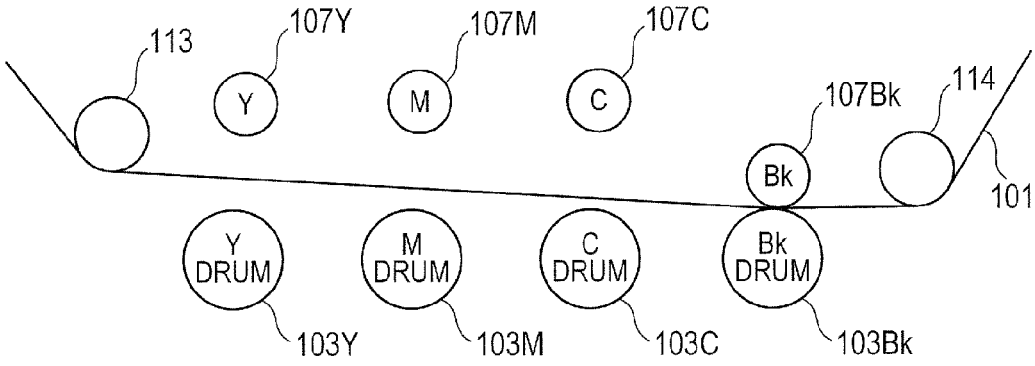
FIG. 4B is a schematic diagram illustrating a positional relationship of the intermediate transfer belt and the respective photosensitive drums in a partly contacted position.
Figure 4C:
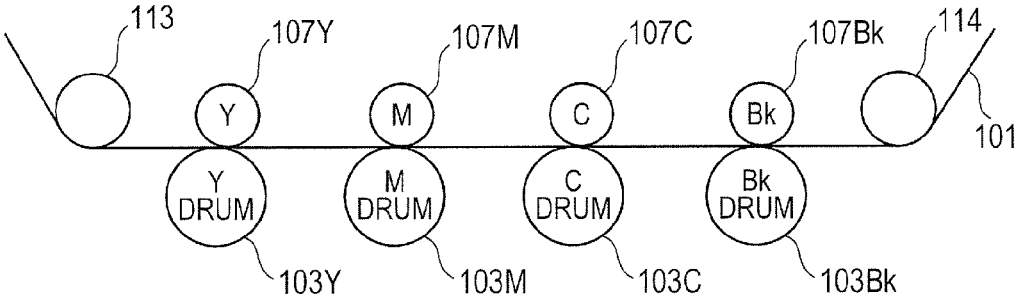
FIG. 4C is a schematic diagram illustrating a positional relationship of the intermediate transfer belt and the respective photosensitive drums in a fully contacted position.

As illustrated in FIG. 4A, when the toner image is not performed, for example, when the image forming operation is stopped, the intermediate transfer belt 101 is set to the fully separated position for separating the intermediate transfer belt 101 from the photosensitive drums 103Y, 103M, 103C, and 103Bk. In this fully separated position, all of the suspension rollers 113 and 114 and the primary transfer rollers 107Y, 107M, 107C, and 107Bk are placed in positions spaced apart from the photosensitive drums 103Y, 103M, 103C, and 103Bk. With this arrangement, excessive jobs are prevented from occurring when the image forming portions 109Y, 109M, 109C, and 109Bk are replaced, which enhances replacement performance.

In this fully separated position, the separation plate 400 is positioned on the left side of FIG. 3, and each rotary shaft is positioned on the side far from the photosensitive drum 103 indicated by the solid line in the right end portion of each engagement hole. Therefore, as illustrated in FIG. 4A, all of the suspension rollers 113 and 114 and the primary transfer rollers 107Y, 107M, 107C, and 107Bk are placed on the side far from the photosensitive drums 103Y, 103M, 103C, and 103Bk. As a result, the intermediate transfer belt 101 is separated from all the photosensitive drums 103Y, 103M, 103C, and 103Bk.

As illustrated in FIG. 4B, when the monochrome mode for forming the toner image by only the photosensitive drum 103Bk is performed, the intermediate transfer belt 101 is set to the partly contacted position. The partly contacted position is a position in which the intermediate transfer belt 101 is separated from the photosensitive drums 103Y, 103M, and 103C and brought into contact with the photosensitive drum 103Bk. To change the fully separated position to the partly contacted position, as illustrated in FIG. 3, the first motor 201 is driven to rotate the partly toothless gear 401 in the direction indicated by the arrow B, to thereby cause the separation plate 400 to move in the direction indicated by the arrow C (toward the right of FIG. 3) by a first predetermined distance.

With this configuration, the rotary shaft 107Bka of the primary transfer roller 107Bk opposed to the photosensitive drum 103Bk and the rotary shaft 114*a* of the suspension roller 114 adjacent thereto are positioned on the side close to the photosensitive drum 103 indicated by the broken lines in the middle portions of the engagement holes 407 and 405. On the other hand, the other rotary shafts 113*a*, 107Ya, 107Ma, and 107Ca are positioned on the side far from the photosensitive drum 103 indicated by the broken lines in the middle portions of the engagement holes 404, 406*a*, 406*b*, and 406*c*.

Therefore, as illustrated in FIG. 4B, the suspension roller 114 and the primary transfer roller 107Bk are positioned on the side of the photosensitive drum 103Bk. At the same time, the suspension roller 113 and the primary transfer rollers 107Y, 107M, and 107C are positioned on the side far from the photosensitive drums 103Y, 103M, and 103C. As a result, the intermediate transfer belt 101 is brought into contact with only the photosensitive drum 103Bk.

As illustrated in FIG. 4C, when the full-color mode for forming the toner image by all the photosensitive drums 103Y, 103M, 103C, and 103Bk is performed, the intermediate transfer belt 101 is set to the fully contacted position. The fully contacted position is a position in which the intermediate transfer belt 101 is brought into contact with all the photosensitive drums 103Y, 103M, 103C, and 103Bk. To change over from the partly contacted position to the fully contacted position, as illustrated in FIG. 3, the first motor 201 is driven to rotate the partly toothless gear 401 in the direction indicated by the arrow B, to thereby cause the separation plate 400 to move in the direction indicated by the arrow C (toward the right of FIG. 3) by a second predetermined distance.

With this configuration, the rotary shaft 107Bka of the primary transfer roller 107Bk and the rotary shaft 114*a* of the suspension roller 114 are positioned on the side close to the photosensitive drum 103 indicated by the broken lines in the left end portions of the engagement holes 407 and 405. Further, the rotary shafts 107Ya, 107Ma, and 107Ca of the primary transfer rollers 107Y, 107M, and 107C are also positioned on the side close to the photosensitive drum 103 indicated by the broken lines in the left end portions of the engagement holes 406*a*, 406*b*, and 406*c*. In addition, the rotary shaft 113*a* of the suspension roller 113 is also positioned on the side close to the photosensitive drum 103 indicated by the broken line in the left end portion of the engagement hole 404. Therefore, as illustrated in FIG. 4C, the suspension rollers 113 and 114 and the primary transfer rollers 107Y, 107M, 107C, and 107Bk are positioned on the side of the photosensitive drum 103. As a result, the intermediate transfer belt 101 is brought into contact with all the photosensitive drums 103Y, 103M, 103C, and 103Bk.

To change over from the fully contacted position illustrated in FIG. 4C to the fully separated position illustrated in FIG. 4A, as described above, the first motor 201 is driven to rotate the partly toothless gear 401 in the direction indicated by the arrow B, to thereby cause the part of the partly toothless gear 401 in which its gear teeth are not formed to be opposed to the rack 402. With this configuration, the separation plate 400 is urged by the spring 403 to move in the direction indicated by the arrow D, and the separation plate 400 returns to the fully separated position.

[Operations of Each Motor and Contact-separation Mechanism During Image Formation Sequence]

Next, operations of the first motor 201, the second motor 202, and the contact-separation mechanism 203 during an image formation sequence will be described with reference to FIGS. 5A, 5B, 6A, and 6B. As described above, the positional relationship of the intermediate transfer belt 101 and the respective photosensitive drums 103 is changed over in the order of the fully separated position→the partly contacted position (monochrome mode)→the fully contacted position (full-color mode)→the fully separated position . . . .

First, the image formation sequence according to the comparative example of the configuration configured to change over the positions in the above-mentioned manner will be described with reference to FIGS. 5A and 5B. In the comparative example, a contact-separation mechanism is driven independently of the rotational driving of the respective photosensitive drums and an intermediate transfer belt. Specifically, the contact-separation mechanism includes a Bk-ITB motor configured to rotationally drive the black photosensitive drum and the intermediate transfer belt, a full-color motor configured to rotationally drive yellow, magenta, and cyan photosensitive drums, and a motor configured to drive the contact-separation mechanism. Therefore, the intermediate transfer belt can be inhibited from rotating even when the contact-separation mechanism is driven.

Figure 5A:
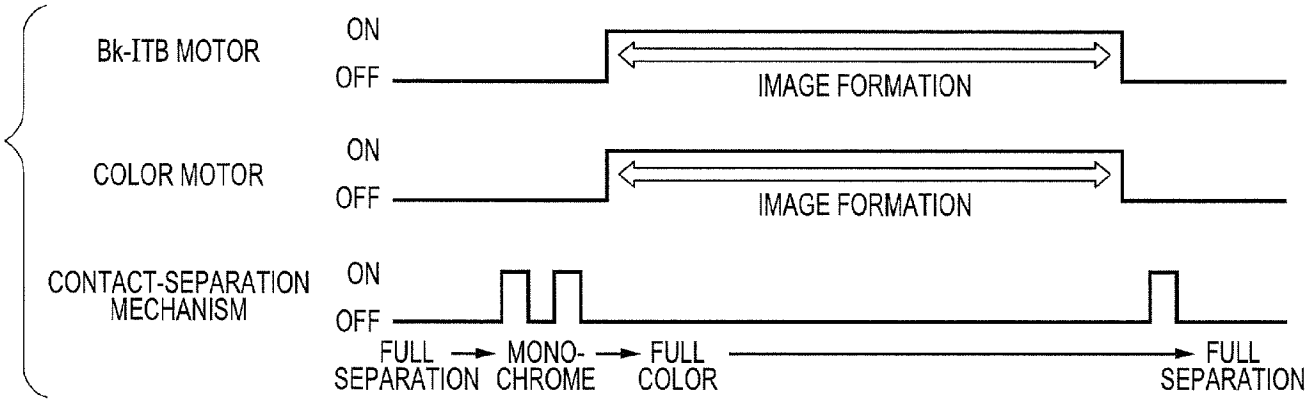
FIG. 5A is a timing chart illustrating operations of respective motors and the contact-separation mechanism during an image formation sequence when a full-color mode according to the comparative example is performed.

In such a case of the comparative example, in the full-color mode illustrated in FIG. 5A, first, the contact-separation mechanism is driven to change over from the fully separated position (full separation) serving as the home position to the fully contacted position (full color) through the partly contacted position (monochrome). After that, the Bk-ITB motor and the full-color motor are driven to perform the image formation. When the image formation is completed, the Bk-ITB motor and the full-color motor are stopped, and then the contact-separation mechanism is driven to change over from the fully contacted position to the fully separated position.

Figure 5B:
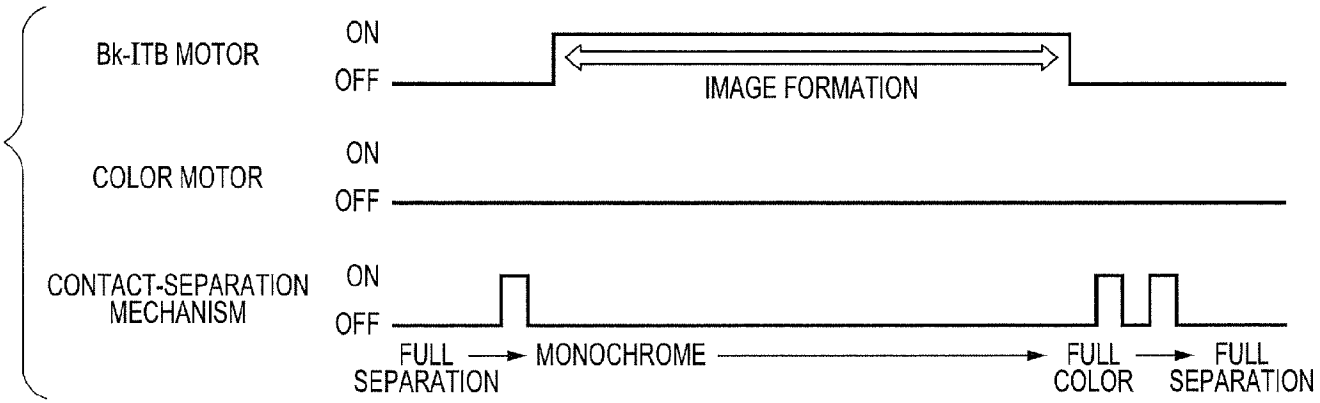
FIG. 5B is a timing chart illustrating operations of the respective motors and the contact-separation mechanism during the image formation sequence when a monochrome mode according to the comparative example is performed.

Further, in the monochrome mode illustrated in FIG. 5B, first, the contact-separation mechanism is driven to change over from the fully separated position (full separation) to the partly contacted position (monochrome). After that, the Bk-ITB motor is driven to perform the image formation. When the image formation is completed, the Bk-ITB motor is stopped, and then the contact-separation mechanism is driven to change over from the partly contacted position to the fully separated position through the fully contacted position. Note that, when the monochrome mode is performed, the drums other than the one for black are stopped. With this configuration, it is possible to suppress wear of parts within the apparatus caused by the rotation of the drums, and to suppress unnecessary power consumption.

In such a case of the comparative example, when the partly contacted position is changed over to the fully separated position at the completion of the monochrome mode, the positional relationship is once changed over to the fully contacted position, to thereby bring the yellow, magenta, and cyan color photosensitive drums into contact with the intermediate transfer belt. However, the contact-separation mechanism is driven independently of the Bk-ITB motor, and hence the intermediate transfer belt can be stopped when the contact-separation mechanism is driven, which can inhibit the color photosensitive drum and the intermediate transfer belt from rubbing each other.

In contrast, in the case of the embodiment, the driving of the contact-separation mechanism 203 and the rotation of the intermediate transfer belt 101 are performed by the common first motor 201, and the contact-separation mechanism 203 and the intermediate transfer belt 101 cannot be driven separately unlike the comparative example. Accordingly, in the embodiment, the yellow, magenta, and cyan photosensitive drums 103Y, 103M, and 103C are rotationally driven when the positional relationship of the intermediate transfer belt and the respective photosensitive drums 103 is once changed over to the fully contacted position in order to perform the monochrome mode.

Figure 6A:
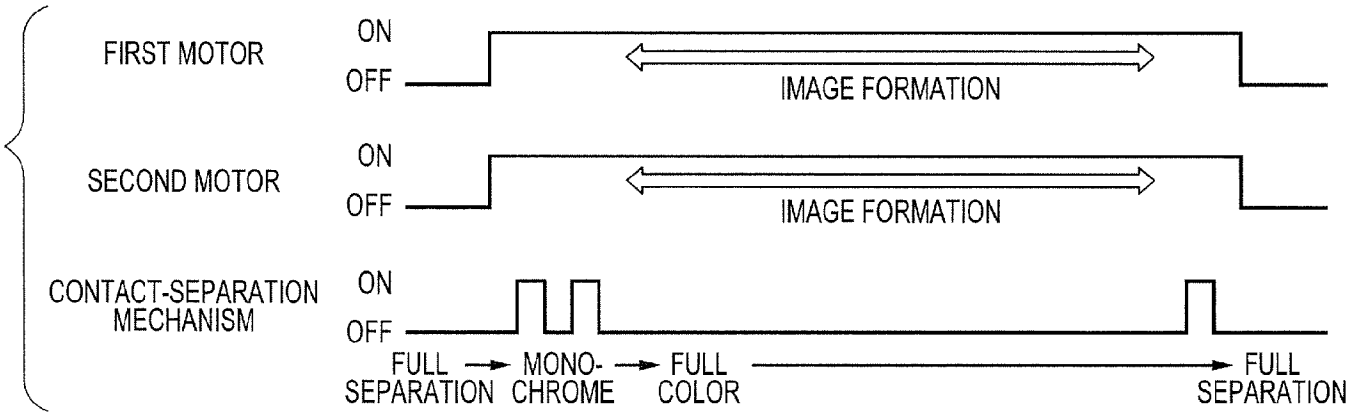
FIG. 6A is a timing chart illustrating operations of the respective motors and the contact-separation mechanism during the image formation sequence when a full-color mode according to the first embodiment is performed.

Such an image formation sequence according to the embodiment will be described with reference to FIGS. 6A and 6B. In the full-color mode (first mode) illustrated in FIG. 6A, first, the control portion 200 drives the first motor 201 and the second motor 202 to rotationally drive the respective photosensitive drums 103 and the intermediate transfer belt 101. In this case, the clutch 204 is used to disconnect the power, to thereby prevent the contact-separation mechanism 203 from being driven by the driving of the first motor 201.

Subsequently, the control portion 200 causes the clutch 204 to connect the power, and drives the first motor 201 to drive the contact-separation mechanism 203, to thereby change over from the fully separated position (full separation) serving as the home position to the fully contacted position (full color) through the partly contacted position (monochrome). In this case, the first motor 201 and the second motor 202 are kept driven, and hence it is possible to suppress the occurrence of rubbing between the respective photosensitive drums 103 and the intermediate transfer belt 101. In the fully contacted position, the clutch 204 is used to disconnect the power to the contact-separation mechanism 203, and then the image formation is started. When the image formation is completed, first, the clutch 204 is used to connect the power again, and drives the contact-separation mechanism 203 to change over from the fully contacted position to the fully separated position. In the fully separated position, the clutch 204 is used to disconnect the power to the contact-separation mechanism 203, and then the first motor 201 and the second motor 202 are stopped.

Figure 6B:
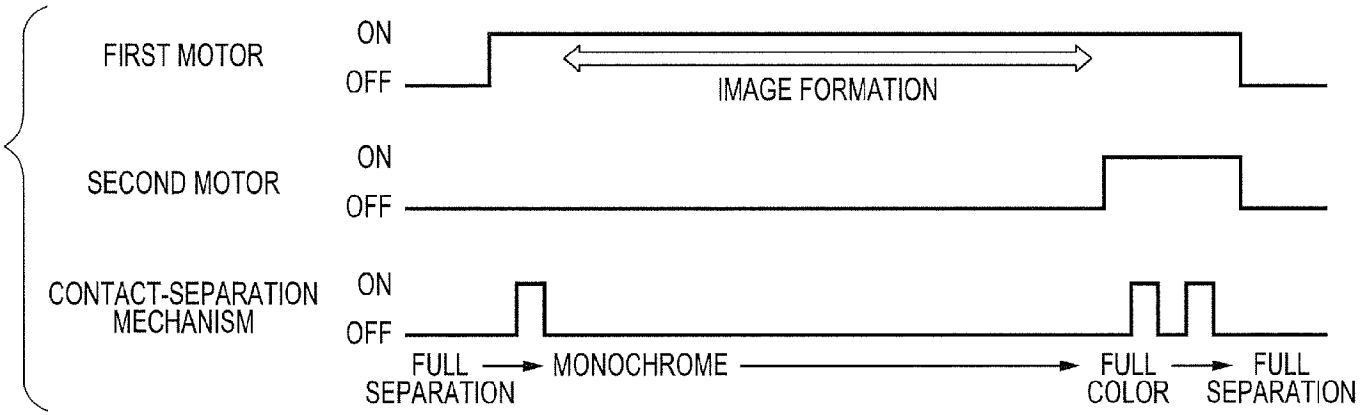
FIG. 6B is a timing chart illustrating operations of the respective motors and the contact-separation mechanism during the image formation sequence when a monochrome mode according to the first embodiment is performed.

On the other hand, in the monochrome mode (second mode) illustrated in FIG. 6B, first, the control portion 200 drives the first motor 201 to rotationally drive the black photosensitive drum 103Bk and the intermediate transfer belt 101. In this case, the clutch 204 is used to disconnect the power, to thereby inhibit the contact-separation mechanism 203 from being driven by the driving of the first motor 201. Further, because of the monochrome mode, the second motor 202 configured to drive the color photosensitive drums 103Y, 103M, and 103C is not driven.

Subsequently, the control portion 200 uses the clutch 204 to connect the power, and drives the first motor 201 to drive the contact-separation mechanism 203, to thereby change over from the fully separated position (full separation) serving as the home position to the partly contacted position (monochrome). In the partly contacted position, the clutch 204 is used to disconnect the power to the contact-separation mechanism 203, and then the image formation is started.

When the image formation is completed, first, the second motor 202 is driven to rotationally drive the color photosensitive drums 103Y, 103M, and 103C. Subsequently, the clutch 204 is again used to connect the power, and drives the contact-separation mechanism 203, to thereby change over from the partly contacted position to the fully separated position through the fully contacted position (full color). In other words, when the partly contacted position is changed over to the fully separated position at the completion of the monochrome mode, the color photosensitive drums 103Y, 103M, and 103C are rotationally driven. In the fully separated position, the clutch 204 is used to disconnect the power to the contact-separation mechanism 203, and then the first motor 201 and the second motor 202 are stopped.

As described above, in the embodiment, the rotation of the intermediate transfer belt 101 and the driving of the contact-separation mechanism 203 are performed by the common first motor 201. Further, with this configuration, the positional relationship is changed over from the fully separated position to the partly contacted position to the fully contacted position in the stated order, and therefore is once changed over through the fully contacted position when the partly contacted position is changed over to the fully separated position at the completion of the monochrome mode. Accordingly, in the embodiment, when the positional relationship is changed through the fully contacted position in association with the performance of the monochrome mode, in other words, at the completion of the monochrome mode, the color photosensitive drums 103Y, 103M, and 103C that are not used in the monochrome mode are rotationally driven. Therefore, when the positional relationship passes through the fully contacted position, it is possible to inhibit the color photosensitive drums 103Y, 103M, and 103C from rubbing the intermediate transfer belt 101 being rotated in association with the driving of the contact-separation mechanism 203. As a result, it is possible to suppress the occurrence of an image failure such as a streaked image due to a flaw caused in the photosensitive drums 103Y, 103M, and 103C and the intermediate transfer belt 101.

<Second Embodiment>

A second embodiment of the present invention will be described with reference to FIGS. 7, 8A, and 8B while referring to FIGS. 1, 2A, 2B, 3, 4A, 4B and 4C. In the above-mentioned first embodiment, the contact-separation mechanism is configured to repeat (cycle) the first operation including the changing operation for changing over from the fully separated position to the partly contacted position to the fully contacted position in the stated order. In contrast, in the second embodiment, a contact-separation mechanism 203A is configured to repeat a second operation including a changing operation for changing over from the fully separated position to the fully contacted position to the partly contacted position in the stated order. The other configuration and operation are the same as those of the above-mentioned first embodiment, and hence duplicate descriptions and illustrations thereof are omitted or simplified below to mainly describe a part different from the first embodiment.

The contact-separation mechanism 203A changes the positional relationship of the intermediate transfer belt 101 and the respective photosensitive drums 103Y, 103M, 103C, and 103Bk in the above-mentioned order. Therefore, as illustrated in FIG. 7, a shape of a part of the engagement holes formed in a separation plate 400A is changed from the configuration of the first embodiment illustrated in FIG. 3.

Figure 7:
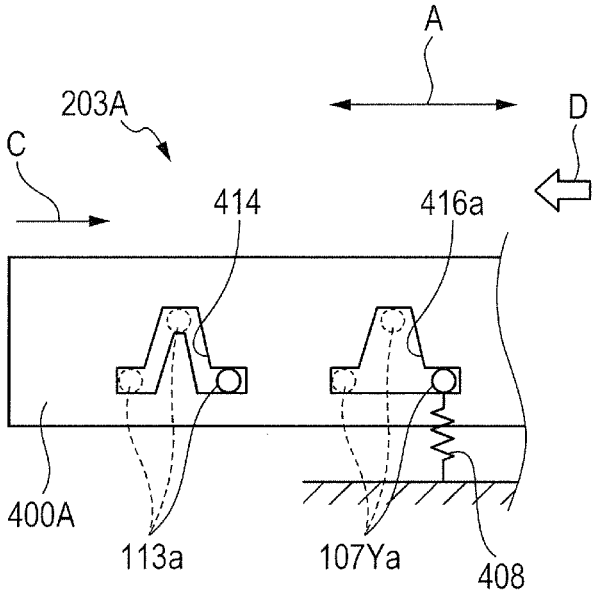
FIG. 7 is a schematic diagram partially illustrating the contact-separation mechanism according to a second embodiment of the present invention.
Figure 8A:
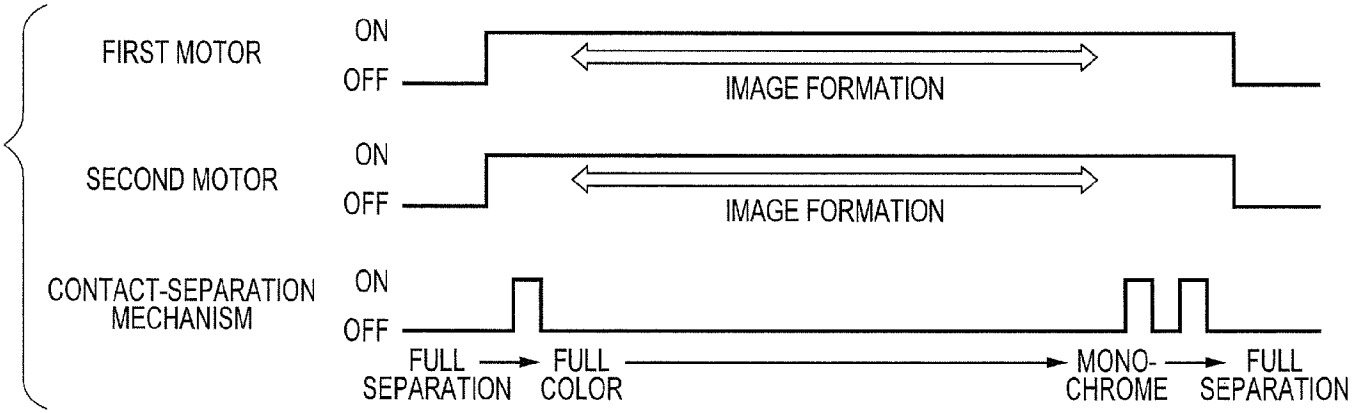
FIG. 8A is a timing chart illustrating operations of the respective motors and the contact-separation mechanism during the image formation sequence when a full-color mode according to the second embodiment is performed.

In other words, the shape of the engagement hole engaged with each of the rotary shaft 113*a* of the suspension roller 113 adjacent to the primary transfer roller 107Y and the rotary shafts 107Ya, 107Ma, and 107Ca of the primary transfer rollers 107Y, 107M, and 107C is changed as illustrated in FIG. 7. Specifically, an engagement hole 414 engaged with the rotary shaft 113*a* of the suspension roller 113 has the right end portion and the left end portion of FIG. 7 formed in the position far from the photosensitive drum 103, and has the middle portion of FIG. 7 formed in the position close to the photosensitive drum 103. The two positions are continuously connected to each other by an inclined portion.

Further, an engagement hole 416*a* engaged with the rotary shaft 107Ya of the primary transfer roller 107Y is formed as follows. Specifically, a surface (upper surface) of the engagement hole 416*a* on the side of the photosensitive drum 103 has the right end portion and the left end portion of FIG. 7 formed in the position far from the photosensitive drum 103, and has the middle portion of FIG. 7 formed in the position close to the photosensitive drum 103. The right end portion and the middle portion are continuously connected to each other by an inclined portion, and the left end portion and the middle portion are continuously connected to each other by an inclined portion. The engagement hole 416*a* has a surface (lower surface), on a farther side from the photosensitive drum 103, formed in parallel with the direction indicated by the arrow A. Although not shown, the engagement hole engaged with each of the rotary shafts 107Ma and 107Ca of the primary transfer rollers 107M and 107C has the same shape as that of the engagement hole 416*a* engaged with the rotary shaft 107Ya. Note that, the engagement hole engaged with each of the rotary shaft 107Bka of the primary transfer roller 107Bk and the rotary shaft 114*a* of the suspension roller 114 adjacent thereto has the same shape as that of the first embodiment illustrated in FIG. 3.

In the case of the embodiment configured in the above-mentioned manner, in the fully separated position, the separation plate 400A is positioned on the left side of FIG. 7, and each rotary shaft is positioned on the side far from the photosensitive drum 103 indicated by the solid line in the right end portion of each engagement hole. In the fully contacted position to which the separation plate 400A moves from the fully separated position in the direction indicated by the arrow C by the first predetermined distance, the rotary shaft 107Bka of the primary transfer roller 107Bk and the rotary shaft 114*a* of the suspension roller 114 are positioned on the side close to the photosensitive drum 103 as illustrated in FIG. 3. Further, the rotary shaft 107Ya of the primary transfer roller 107Y is positioned on the side close to the photosensitive drum 103 indicated by the broken line in the middle portion of the engagement hole 416*a*. The same applies to the rotary shafts 107Ma and 107Ca of the primary transfer rollers 107M and 107C. In addition, the rotary shaft 113*a* of the suspension roller 113 is also positioned on the side close to the photosensitive drum 103 indicated by the broken line in the middle portion of the engagement hole 414.

In the partly contacted position to which the separation plate 400A moves from the fully contacted position in the direction indicated by the arrow C by the second predetermined distance, the rotary shaft 107Bka of the primary transfer roller 107Bk and the rotary shaft 114*a* of the suspension roller 114 are positioned on the side close to the photosensitive drum 103 as illustrated in FIG. 3. Further, the rotary shaft 107Ya of the primary transfer roller 107Y is positioned on the side far from the photosensitive drum 103 indicated by the broken line in the left end portion of the engagement hole 416*a*. The same applies to the rotary shafts 107Ma and 107Ca of the primary transfer rollers 107M and 107C. In addition, the rotary shaft 113*a* of the suspension roller 113 is also positioned on the side far from the photosensitive drum 103 indicated by the broken line in the left end portion of the engagement hole 414. To change the partly contacted position to the fully separated position, the partly toothless gear 401 is rotated in the direction indicated by the arrow B to cause the part of the partly toothless gear 401 in which its gear teeth are not formed to be opposed to the rack 402 as illustrated in FIG. 3. With this configuration, the separation plate 400A is urged by the spring 403 illustrated in FIG. 3 to move in the direction indicated by the arrow D, and the separation plate 400A returns to the fully separated position.

Next, the operations of the first motor 201, the second motor 202, and the contact-separation mechanism 203A during the image formation sequence according to the embodiment will be described with reference to FIGS. 8A and 8B while referring to FIGS. 1, 2A, 2B, and 7. As described above, the positional relationship of the intermediate transfer belt 101 and the respective photosensitive drums 103 is changed over in the order of the fully separated position→the fully contacted position (full-color mode)→the partly contacted position (monochrome mode)→the fully separated position . . . .

In such a case of the embodiment, when the fully separated position is changed over to the partly contacted position at the start of the monochrome mode (second mode), the color photosensitive drums 103Y, 103M, and 103C are rotationally driven. First, in the full-color mode (first mode) illustrated in FIG. 8A, the control portion 200 drives the first motor 201 and the second motor 202 to rotationally drive the respective photosensitive drums 103 and the intermediate transfer belt 101. In this case, the clutch 204 is used to disconnect the power, to thereby prevent the contact-separation mechanism 203A from being driven by the driving of the first motor 201.

Subsequently, the control portion 200 uses the clutch 204 to connect the power, and drives the first motor 201 to drive the contact-separation mechanism 203A, to thereby change over from the fully separated position (full separation) serving as the home position to the fully contacted position (full color). In the fully contacted position, the clutch 204 is used to disconnect the power to the contact-separation mechanism 203A, and then the image formation is started. When the image formation is completed, first, the clutch 204 is used to connect the power to drive the contact-separation mechanism 203A again, and the fully contacted position is changed over to the fully separated position through the partly contacted position (monochrome). In this case, the first motor 201 and the second motor 202 are kept being driven, and hence it is possible to suppress the occurrence of the rubbing between the respective photosensitive drums 103 and the intermediate transfer belt 101. In the fully separated position, the clutch 204 is used to disconnect the power to the contact-separation mechanism 203A, and then the first motor 201 and the second motor 202 are stopped.

Figure 8B:
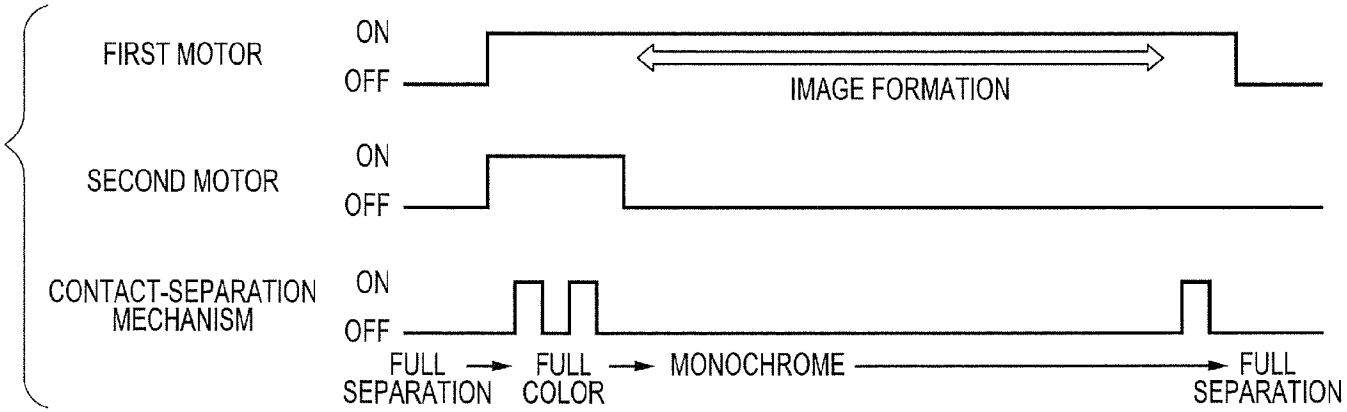
FIG. 8B is a timing chart illustrating operations of the respective motors and the contact-separation mechanism during the image formation sequence when a monochrome mode according to the second embodiment is performed.

On the other hand, in the monochrome mode (second mode) illustrated in FIG. 8B, the first motor 201 and the second motor 202 are driven to rotationally drive the respective photosensitive drums 103 and the intermediate transfer belt 101. In other words, in the monochrome mode, it suffices that the black photosensitive drum 103Bk be rotationally driven, but as described below, the positional relationship is changed over through the fully contacted position when the fully separated position is changed over to the partly contacted position, and hence the color photosensitive drums 103Y, 103M, and 103C are also rotationally driven. In this case, the clutch 204 is used to disconnect the power, to thereby prevent the contact-separation mechanism 203A from being driven by the driving of the first motor 201.

Subsequently, the control portion 200 uses the clutch 204 to connect the power, and drives the first motor 201 to drive the contact-separation mechanism 203A, to thereby change over from the fully separated position (full separation) serving as the home position to the partly contacted position (monochrome) through the fully contacted position (full color). In the partly contacted position, the clutch 204 is used to disconnect the power to the contact-separation mechanism 203, and then the image formation is started. Further, in this case, because of the monochrome mode, the second motor 202 configured to drive the color photosensitive drums 103Y, 103M, and 103C is stopped. When the image formation is completed, the clutch 204 is used to connect the power again, and drives the contact-separation mechanism 203A to change over from the partly contacted position to the fully separated position. In the fully separated position, the clutch 204 is used to disconnect the power to the contact-separation mechanism 203A, and then the first motor 201 is stopped.

In such a case of the embodiment, the positional relationship is changed over from the fully separated position to the fully contacted position to the partly contacted position in the stated order, and therefore is once changed over to the fully contacted position when the fully separated position is changed over to the partly contacted position to start the monochrome mode. Accordingly, in the embodiment, when the monochrome mode is started, the color photosensitive drums 103Y, 103M, and 103C that are not used in the monochrome mode are rotationally driven. Therefore, when the positional relationship passes through the fully contacted position, it is possible to inhibit the color photosensitive drums 103Y, 103M, and 103C from rubbing the intermediate transfer belt 101 being rotated in association with the driving of the contact-separation mechanism 203A. As a result, it is possible to suppress the occurrence of an image failure such as a streaked image due to a flaw caused in the photosensitive drums 103Y, 103M, and 103C and the intermediate transfer belt 101.

Note that, in the case of the embodiment, when the partly contacted position is changed over to the fully separated position at the completion of the monochrome mode, the separation plate 400A is urged by the spring 403 illustrated in FIG. 3 to move in the direction indicated by the arrow D, and the separation plate 400A returns to the fully separated position. At this time, as apparent from the shape of the engagement hole 416*a* engaged with the rotary shaft 107Ya of the primary transfer roller 107Y illustrated in FIG. 7, the positional relationship of the respective photosensitive drums 103 and the intermediate transfer belt 101 passes through the fully contacted position. However, a time period during which the positional relationship passes through the fully contacted position in this case is very short, and in turn, a time period during which the color photosensitive drums 103Y, 103M, and 103C and the intermediate transfer belt 101 rub each other is also very short. Therefore, in the embodiment, when the partly contacted position is changed over to the fully separated position at the completion of the monochrome mode, the color photosensitive drums 103Y, 103M, and 103C are not rotationally driven. However, it is preferred that the color photosensitive drums 103Y, 103M, and 103C be rotationally driven even in a case where the time period during which the positional relationship passes through the fully contacted position is very short when the partly contacted position is changed over to the fully separated position at the completion of the monochrome mode as described above.

<Third Embodiment>

Figure 10:
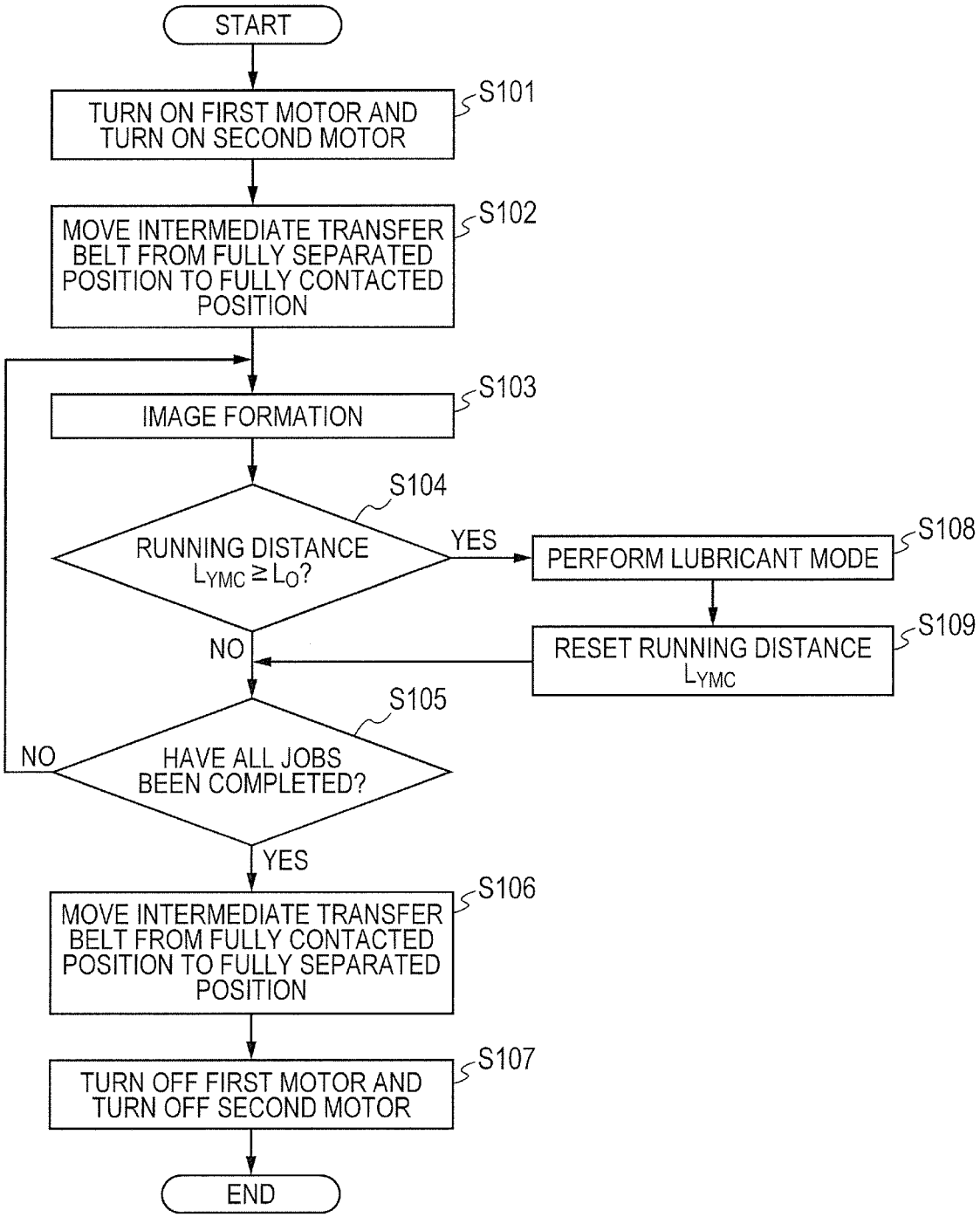
FIG. 10 is a flowchart illustrating control of a lubricant mode when a full-color mode according to the third embodiment is performed.
Figure 11:
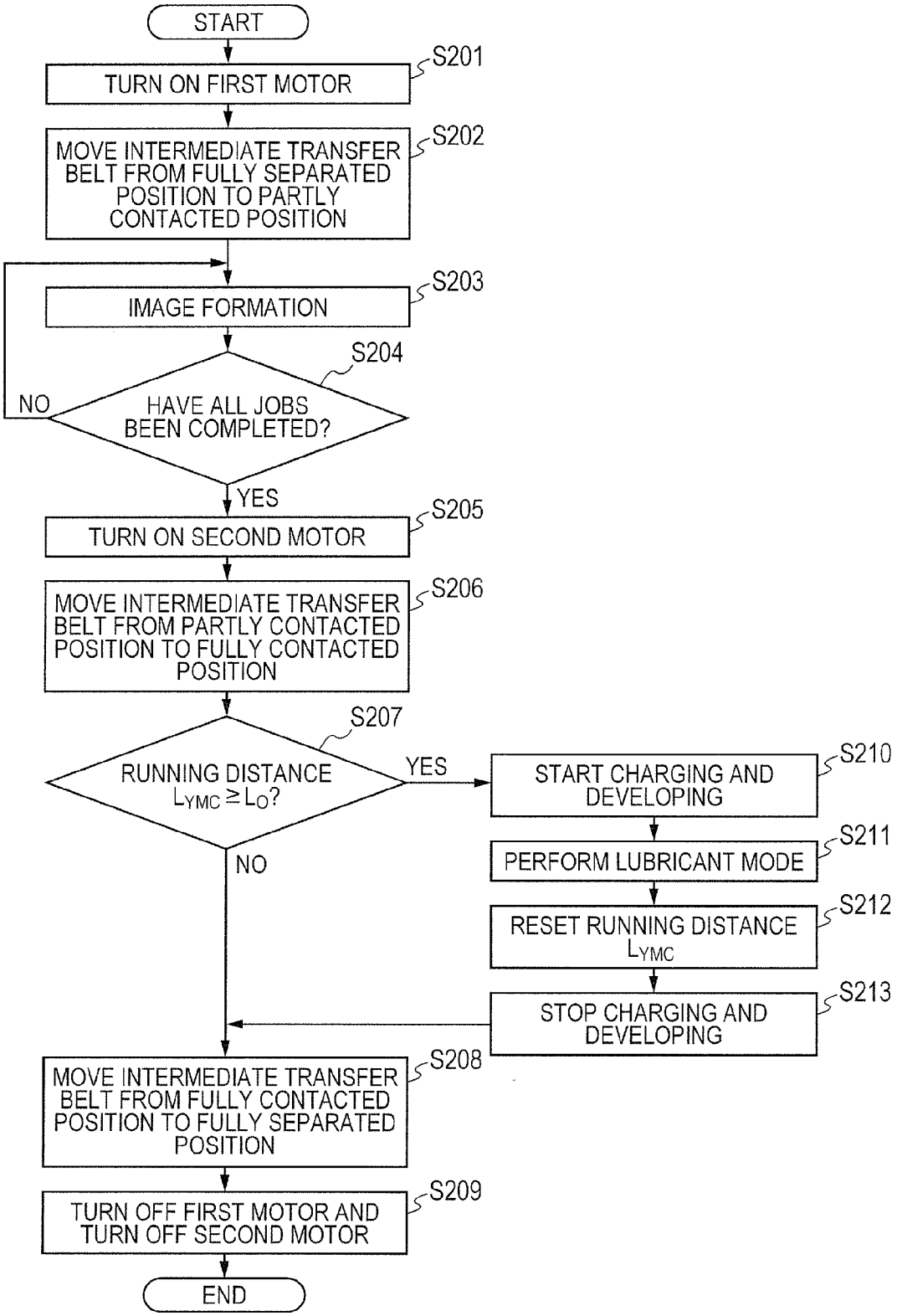
FIG. 11 is a flowchart illustrating control of the lubricant mode when a monochrome mode according to the third embodiment is performed.

A third embodiment of the present invention will be described with reference to FIG. 9 to FIG. 11 while referring to FIGS. 1, 2A, 2B, 4A, 4B and 4C. In each of the above-mentioned embodiments, the rotation of the intermediate transfer belt 101 and the driving of the contact-separation mechanism 203 are performed by the common first motor 201, and the positional relationship is changed over in the order of the fully separated position, the partly contacted position, and the fully contacted position or in the order of the fully separated position, the fully contacted position, and the partly contacted position. Further, when the positional relationship passes through the fully contacted position in association with the performance of the monochrome mode, the color photosensitive drums 103Y, 103M, and 103C that are not used in the monochrome mode are rotationally driven.

Here, in the monochrome mode, the toner image is not formed on the color photosensitive drum 103Y, 103M, or 103C. Therefore, as described above, when those color photosensitive drums 103 are rotationally driven in the monochrome mode, toner or an external additive serving as a lubricant is not supplied to the drum cleaning blade 108 serving as the cleaning unit. When the color photosensitive drum 103 is kept driven in this state, the toner or the external additive between the photosensitive drum 103 and the drum cleaning blade 108 is exhausted to increase a friction force between the drum cleaning blade 108 and the photosensitive drum 103. As a result, a blade turn-up that turns over the drum cleaning blade 108 may occur.

Therefore, in the embodiment, the occurrence of such a blade turn-up as described above is suppressed by performing a lubricant mode for supplying a lubricant to color drum cleaning blades 108Y, 108M, and 108C even in the monochrome mode. Note that, in the embodiment, in the same manner as in the first embodiment, the positional relationship is changed over from the fully separated position to the partly contacted position to the fully contacted position in the stated order.

Figure 9:
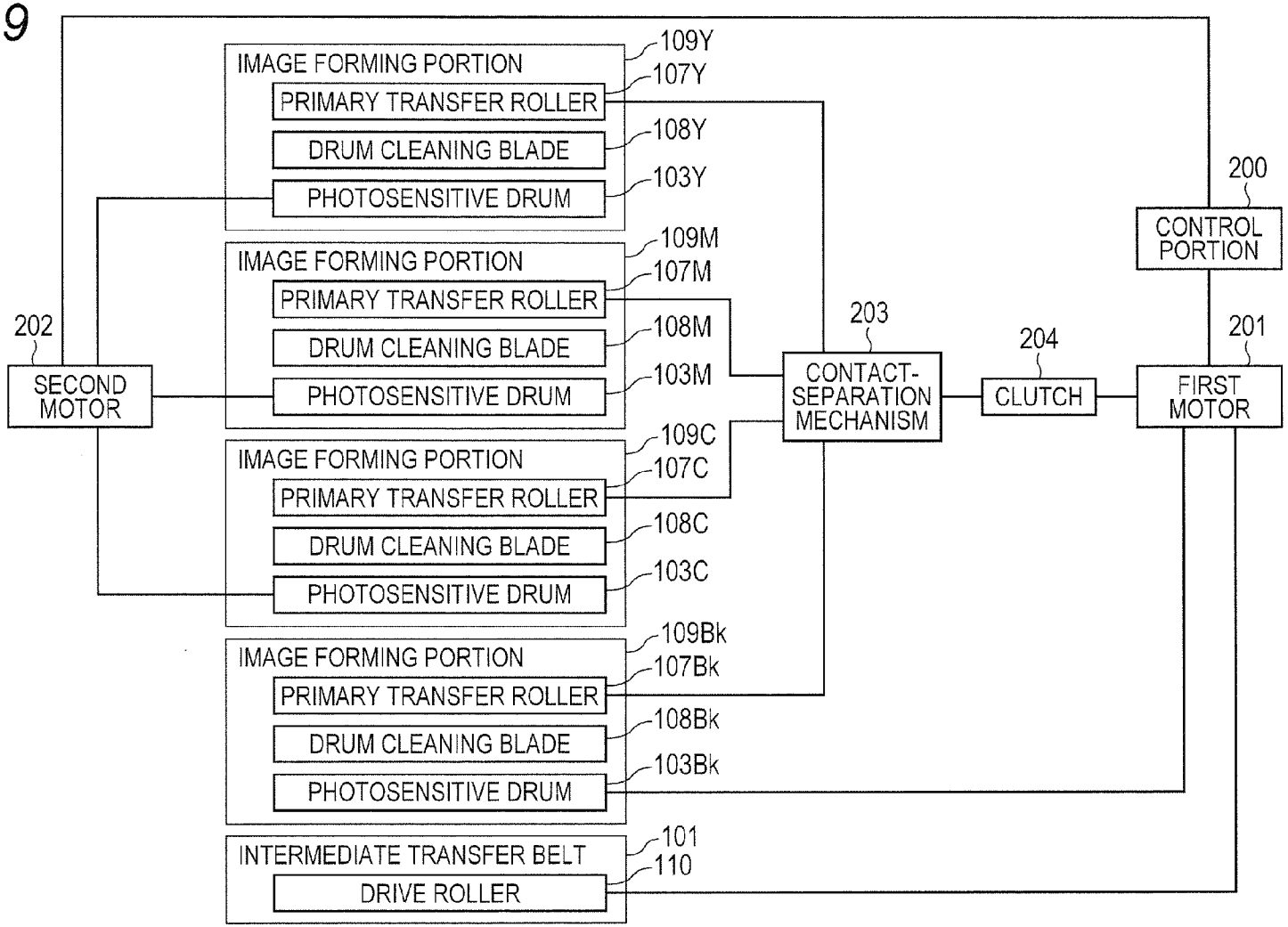
FIG. 9 is a block diagram illustrating a principal part of an image forming apparatus according to a third embodiment of the present invention.

FIG. 9 is a block diagram illustrating a schematic configuration of an image forming apparatus according to the embodiment. The respective components are as described above in the first embodiment, and hence detailed descriptions thereof are omitted. In the lubricant mode according to the embodiment, the control portion 200 supplies the lubricant with use of a lubricant supply unit (supply device) when an accumulated used amount of the color photosensitive drums 103Y, 103M, and 103C serving as the first image bearing members becomes equal to or larger than a predetermined threshold value. In other words, the control portion 200 supplies the lubricant with use of the lubricant supply unit based on the accumulated used amount of the color photosensitive drums including the accumulated used amount of the color photosensitive drums driven in association with the monochrome mode. The lubricant supply unit can supply the lubricant between the color photosensitive drum 103 and the drum cleaning blade 108, and in the embodiment, supplies the toner image serving as the lubricant formed by the first toner image forming unit. As described above, the first toner image forming unit includes the charging rollers 104Y, 104M, and 104C, the exposure devices 105Y, 105M, and 105C, and the developing devices 106Y, 106M, and 106C of the image forming portions 109Y, 109M, and 109C, respectively.

Note that, in the embodiment, as described later, a toner image serving as the lubricant is supplied to also between the black photosensitive drum 103Bk and a drum cleaning blade 108Bk in accordance with the accumulated used amount of the photosensitive drum 103Bk. The thus supplied toner image is formed by the second toner image forming unit. As described above, the second toner image forming unit includes the charging roller 104Bk, the exposure device 105Bk, and the developing device 106Bk of the image forming portion 109Bk.

[Lubricant Mode]

Now, such a lubricant mode will be described in detail. In the embodiment, the lubricant mode is performed based on a running distance, in other words, an accumulated rotation amount of each of the photosensitive drums 103 as the accumulated used amount of each of the photosensitive drums 103. The running distance is assumed as, for example, a distance from the start position of the rotation of the photosensitive drum 103 to the stopped position without taking the contact and separation of the intermediate transfer belt 101 into consideration.

Note that, such a running distance serving as the accumulated used amount is calculated by, for example, providing the motor configured to drive the photosensitive drum 103 with an encoder configured to detect a rotation amount and by accumulating the rotation amount by the control portion 200. Specifically, the running distance can be calculated based on the accumulated rotation amount (for example, number of revolutions) of the photosensitive drum 103 and a circumferential length of the photosensitive drum 103. The circumferential length is constant, and hence the running distance and the accumulated rotation amount can be handled in the same manner. Accordingly, the accumulated rotation amount is a concept including the running distance. Further, the accumulated used amount may be not only the accumulated rotation amount but also an accumulated used time or the like. When the accumulated used time is used as the accumulated used amount, the control portion 200 calculates the accumulated used time by accumulating a drive time of the photosensitive drum 103. The following description is directed to the case of using the running distance as the accumulated used amount, but the same applies to the case of using the accumulated used time.

In the embodiment, the color photosensitive drums 103Y, 103M, and 103C are driven in common by the second motor 202, and therefore have a common running distance. Accordingly, it suffices to calculate two kinds of running distance as the running distance, in other words, a running distance $L_{YMC}$ of the photosensitive drums 103Y, 103M, and 103C and a running distance $L_{Bk}$ of the photosensitive drum 103Bk. Note that, when separate motors are used to drive the photosensitive drums 103Y, 103M, and 103C, respectively, it is necessary to calculate the running distances of the respective photosensitive drums.

The lubricant mode, in other words, the supply of the lubricant to the drum cleaning blade 108 is performed in each of cases where the running distances $L_{YMC}$ and $L_{Bk}$ become equal to or larger than a predetermined threshold value (in the embodiment, reach a predetermined threshold value $L_0$). In other words, when the running distance $L_{YMC}$ reaches the threshold value $L_0$, the lubricant is supplied to the drum cleaning blades 108Y, 108M, and 108C. On the other hand, when the running distance $L_{Bk}$ reaches the threshold value $L_0$, the lubricant is supplied to the drum cleaning blade 108Bk. Note that, in the embodiment, the predetermined threshold value $L_0$ is set to 50,000 mm.

Further, as described above, the thus supplied lubricant is the toner image formed by the first toner image forming unit or the second toner image forming unit, and the toner image serving as the lubricant is a toner band which is not to be subjected to the image formation. Specifically, a toner band formed across an entire developing width, which has a length of 20 mm in the conveying direction and a transferred mass per area of 0.2 mg/cm$^2$ is supplied as the lubricant. This toner band is formed in accordance with the same procedure as at a time of the normal image forming. At this time, the DC voltage is not applied to the primary transfer roller 107, or a DC voltage having a reverse polarity to that applied at the time of the image formation is applied thereto. With this configuration, it is possible to reduce an amount of the toner band to be transferred onto the intermediate transfer belt 101, and to efficiently supply the toner band to the drum cleaning blade 108. Further, by applying the direct voltage having the reverse polarity to that applied at the time of the image formation to the secondary transfer roller 111, it is possible to suppress a toner stain on the secondary transfer roller 111.

The running distances $L_{YMC}$ and $L_{Bk}$ of the photosensitive drum 103 are counted in common at the time of the image formation in the full-color mode and at the time of the image formation in the monochrome mode. However, in a state in which the photosensitive drum 103 is not charged, the toner or the external additive serving as the lubricant is less likely to exhaust between the photosensitive drum 103 and the drum cleaning blade 108 (at a rubbed portion) than in a state in which the photosensitive drum 103 is charged. Therefore, the running distance is calculated by assigning such a weight as described below.

In other words, in the state in which the photosensitive drum 103 is charged, an electrostatic discharge product such as ozone or nitrogen oxides generated by a discharge from the charging roller 104 adheres to the photosensitive drum 103, which increases a friction between the photosensitive drum 103 and the drum cleaning blade 108. Accordingly, in this state, the drum cleaning blade 108 is more strongly pulled in by the photosensitive drum 103 to turn up, and the toner or the external additive is easy to slip out of the rubbed portion between the drum and the blade. On the other hand, in the state in which the photosensitive drum 103 is not charged, it is possible to suppress an increase in the friction between the photosensitive drum 103 and the drum cleaning blade 108 due to the electrostatic discharge product, and the toner or the external additive serving as the lubricant is less likely to slip out of the rubbed portion between the drum and the blade. Accordingly, in the state in which the photosensitive drum 103 is not charged, the toner or the external additive serving as the lubricant is less likely to exhaust between the photosensitive drum 103 and the drum cleaning blade 108 (at the rubbed portion) than in the state in which the photosensitive drum 103 is charged. For example, at the time of the image formation in the monochrome mode, the photosensitive drums 103Y, 103M, and 103C are driven in the state in which the photosensitive drum 103 is not charged.

Therefore, when the photosensitive drum 103 runs the same distance in a charged state in which the photosensitive drum 103 is charged and in a non-charged state in which the photosensitive drum 103 is not charged, less influence is exerted on an increase in a friction force between the drum and the blade in the non-charged state than in the charged state. Therefore, in order to prevent an increase of downtime or large consumption of the lubricant to be caused by frequently performing the lubricant mode, it is desired that different weights be assigned to how to count the running distances $L_{YMC}$ and $L_{Bk}$ between at a charging time of the photosensitive drum 103 and at a non-charging time of the photosensitive drum 103.

Specifically, on the assumption that the actual accumulated used amounts are the same between when the surface of the photosensitive drum 103 is not charged (non-charged state) and when the surface of the photosensitive drum 103 is charged (charged state), the control portion 200 calculates the running distance of the photosensitive drum 103 as follows. Specifically, the calculation of at least any one of the running distances is weighted so that a calculation result of the running distance in the non-charged state becomes smaller than a calculation result of the running distance in the charged state, and a total sum of both the calculation results of the running distances is set as the running distance of the photosensitive drum 103. In the embodiment, the actual running distances are counted as $L_{YMC}$ and $L_{Bk}$ in the charged state, and halves of the actual running distances are counted as $L_{YMC}$ and $L_{Bk}$ in the non-charged state.

Now, the lubricant supply to the drum cleaning blades 108Y, 108M, and 108C will be described for the full-color mode and the monochrome mode separately. First, the lubricant mode to be performed at the time of the image formation in the full-color mode will be described with reference to FIG. 10.

[Full-color Mode]

In the full-color mode, the control portion 200 receives an image forming job, starts to drive the first motor 201 and the second motor 202 (S101), and moves the intermediate transfer belt 101 from the fully separated position to the fully contacted position (S102). Then, the control portion 200 performs full-color image formation (S103), and then determines whether or not the running distance $L_{YMC}$ of the photosensitive drums 103Y, 103M, and 103C has reached the threshold value $L_0$ (S104).

When the running distance $L_{YMC}$ is smaller than the threshold value $L_0$ (NO in S104), the control portion 200 confirms whether or not all the jobs have been completed (S105). When the running distance $L_{YMC}$ has reached the threshold value $L_0$ (YES in S104), the control portion 200 performs the lubricant mode for supplying the toner band to the drum cleaning blades 108Y, 108M, and 108C (S108). After performing the lubricant mode, the control portion 200 resets the running distance $L_{YMC}$ (S109), and proceeds to Step S105.

When there is a job left in Step S105 (NO in S105), the control portion 200 returns to Step S103, and then restarts the image formation. When all the jobs have been completed (YES in S105), the control portion 200 moves the intermediate transfer belt 101 from the fully contacted position to the fully separated position (S106). Then, the control portion 200 stops the first motor 201 and the second motor 202 (S107).

[Monochrome Mode]

Next, the lubricant mode to be performed at the time of the image formation in the monochrome mode will be described with reference to FIG. 11. In the monochrome mode, the control portion 200 receives an image forming job, starts to drive the first motor 201 (S201), and moves the intermediate transfer belt 101 from the fully separated position to the partly contacted position (S202). Then, the control portion 200 performs the monochrome image formation (S203), and confirms whether or not all the jobs have been completed (S204). When there is a job left (NO in S204), the control portion 200 returns to Step S203, and then restarts the image formation. When all the jobs have been completed (YES in S204), the control portion 200 starts to drive the second motor 202 (S205), and moves the intermediate transfer belt 101 from the partly contacted position to the fully contacted position in a state in which the photosensitive drums 103Y, 103M, and 103C are rotationally driven (S206). After the moving, the control portion 200 determines whether or not the running distance $L_{YMC}$ of the photosensitive drums 103Y, 103M, and 103C has reached the threshold value $L_0$ (has become equal to or larger than the threshold value) (S207).

When the running distance $L_{YMC}$ is smaller than the threshold value $L_0$ (NO in S207), the control portion 200 moves the intermediate transfer belt 101 from the fully contacted position to the fully separated position (S208), and stops the first motor 201 and the second motor 202 (S209). On the other hand, when the running distance $L_{YNC}$ has reached the threshold value $L_0$ (YES in S207), the control portion 200 starts charging and developing of the image forming portions 109Y, 109M, and 109C (S210). Then, the control portion 200 performs the lubricant mode for supplying the toner band to the drum cleaning blades 108Y, 108M, and 108C (S211). After performing the lubricant mode, the control portion 200 resets the running distance $L_{YMC}$ (S212), stops the charging and the developing of the image forming portions 109Y, 109M, and 109C (S213), and proceeds to Step S208.

The lubricant supply to the drum cleaning blades 108Y, 108M, and 108C is described above, but the lubricant supply to the drum cleaning blade 108Bk is performed in the same manner. In other words, the lubricant mode for supplying the toner band to the drum cleaning blade 108Bk may be performed by determining whether or not the running distance $L_{Bk}$ has reached the threshold value $L_0$ at the time of the full-color mode and at the time of the monochrome mode in the same manner as in the above-mentioned case.

In the case of the embodiment, as described above, the running distance serving as the accumulated used amount of the photosensitive drum 103 is calculated, and when the running distance becomes equal to or larger than a predetermined threshold value, the lubricant mode is performed. Therefore, it is possible to suppress the occurrence of the blade turn-up. In particular, even when the positional relationship of the intermediate transfer belt 101 and the respective photosensitive drums 103 is changed in order while the intermediate transfer belt 101 and the contact-separation mechanism 203 are driven in common as in the embodiment, it is possible to suppress the occurrence of the blade turn-up.

In other words, in the case of such a configuration, the toner image is not formed on the color photosensitive drum 103Y, 103M, or 103C in the monochrome mode. Therefore, as described above, when those color photosensitive drums 103 are rotationally driven in the monochrome mode, the toner or the external additive serving as the lubricant is not supplied to the drum cleaning blade 108. Therefore, as in the embodiment, by performing the lubricant mode for supplying the lubricant to the color drum cleaning blades 108Y, 108M, and 108C even in the monochrome mode, it is possible to suppress the occurrence of the blade turn-up as described above.

Note that, in the embodiment, in the same manner as in the first embodiment, the positional relationship of the intermediate transfer belt 101 and the respective photosensitive drums 103 is changed over from the fully separated position to the partly contacted position to the fully contacted position in the stated order. However, in the same manner as in the second embodiment, the positional relationship of the intermediate transfer belt 101 and the respective photosensitive drums 103 may be changed over from the fully separated position to the fully contacted position to the partly contacted position in the stated order. Here, in a case of applying the configuration of the first embodiment to the third embodiment, as illustrated in FIG. 11, the positional relationship passes through the fully contacted position when the intermediate transfer belt 101 is moved from the partly contacted position to the fully separated position at the completion of the monochrome mode. Therefore, the running distance of the color photosensitive drum is compared with the threshold value when the monochrome mode is completed. In contrast, in a case of applying the configuration of the second embodiment to the third embodiment, at the start of the monochrome mode, the positional relationship passes through the fully contacted position when the intermediate transfer belt 101 is moved from the fully separated position to the partly contacted position, and hence the running distance of the color photosensitive drum may be compared with the threshold value at this time.

Further, in the third embodiment, the running distance serving as the accumulated used amount of the photosensitive drum 103 is counted in common at the time of the image formation in the full-color mode (first mode) and at the time of the image formation in the monochrome mode (second mode). However, as described above, when the color photosensitive drums are rotationally driven in the monochrome mode, the toner image is not formed, and hence the toner or the external additive is not supplied at the rubbed portion between the drum and the blade. Therefore, the accumulated used amount of the photosensitive drum 103 may be counted when the monochrome mode is performed (without being counted in the full-color mode), and when the accumulated used amount becomes equal to or larger than a predetermined threshold value, the lubricant mode may be performed by the color image forming portion. In other words, the running distance or the like is counted when the color photosensitive drum is actually rotated in the monochrome mode, and when the running distance or the like becomes equal to or larger than a predetermined threshold value, the lubricant mode is performed. In this case, when the accumulated used amount is set to the running distance, the predetermined threshold value is set to, for example, 30,000 mm.

<Fourth Embodiment>

Figure 12:
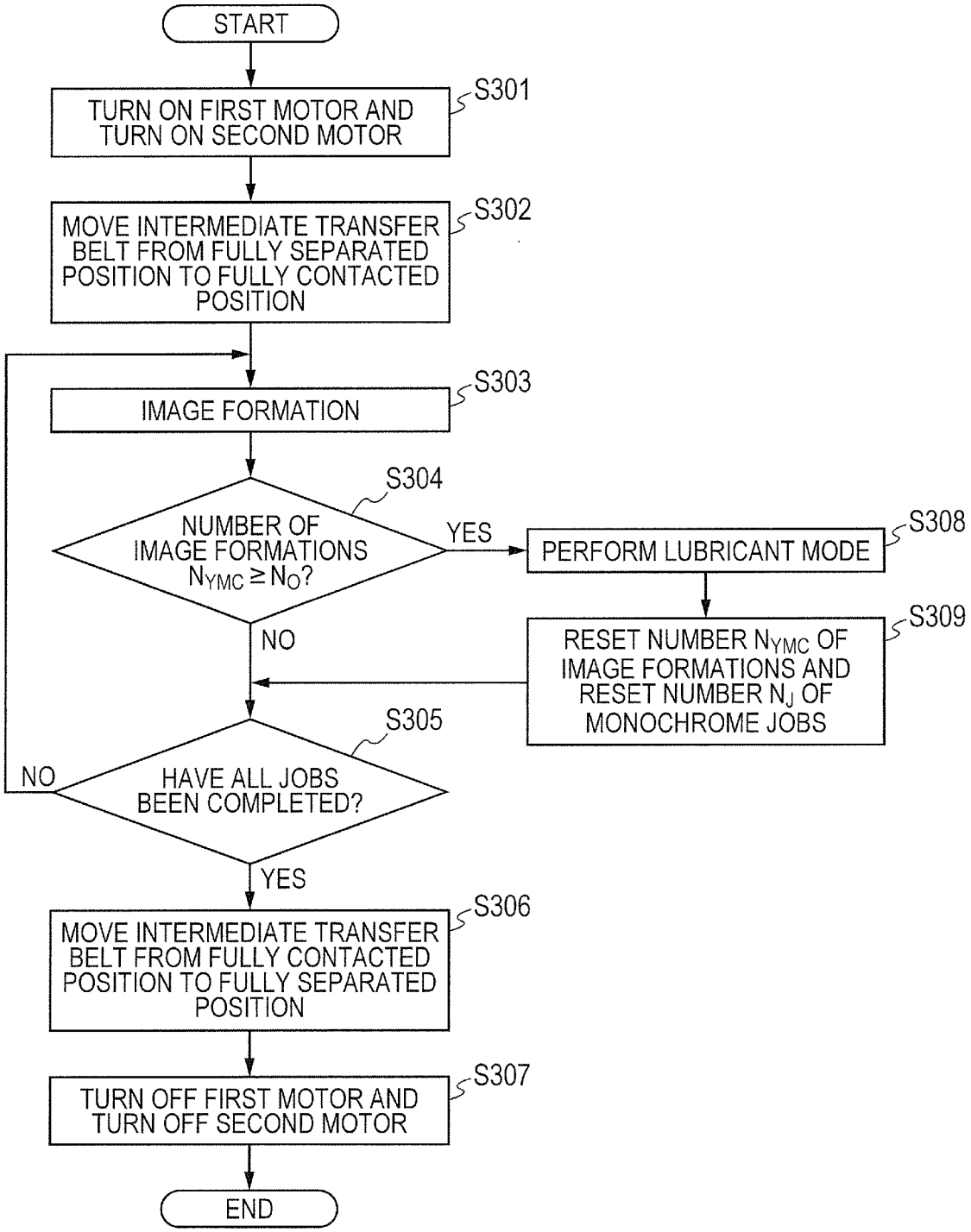
FIG. 12 is a flowchart illustrating control of the lubricant mode when a full-color mode according to a fourth embodiment of the present invention is performed.
Figure 13:
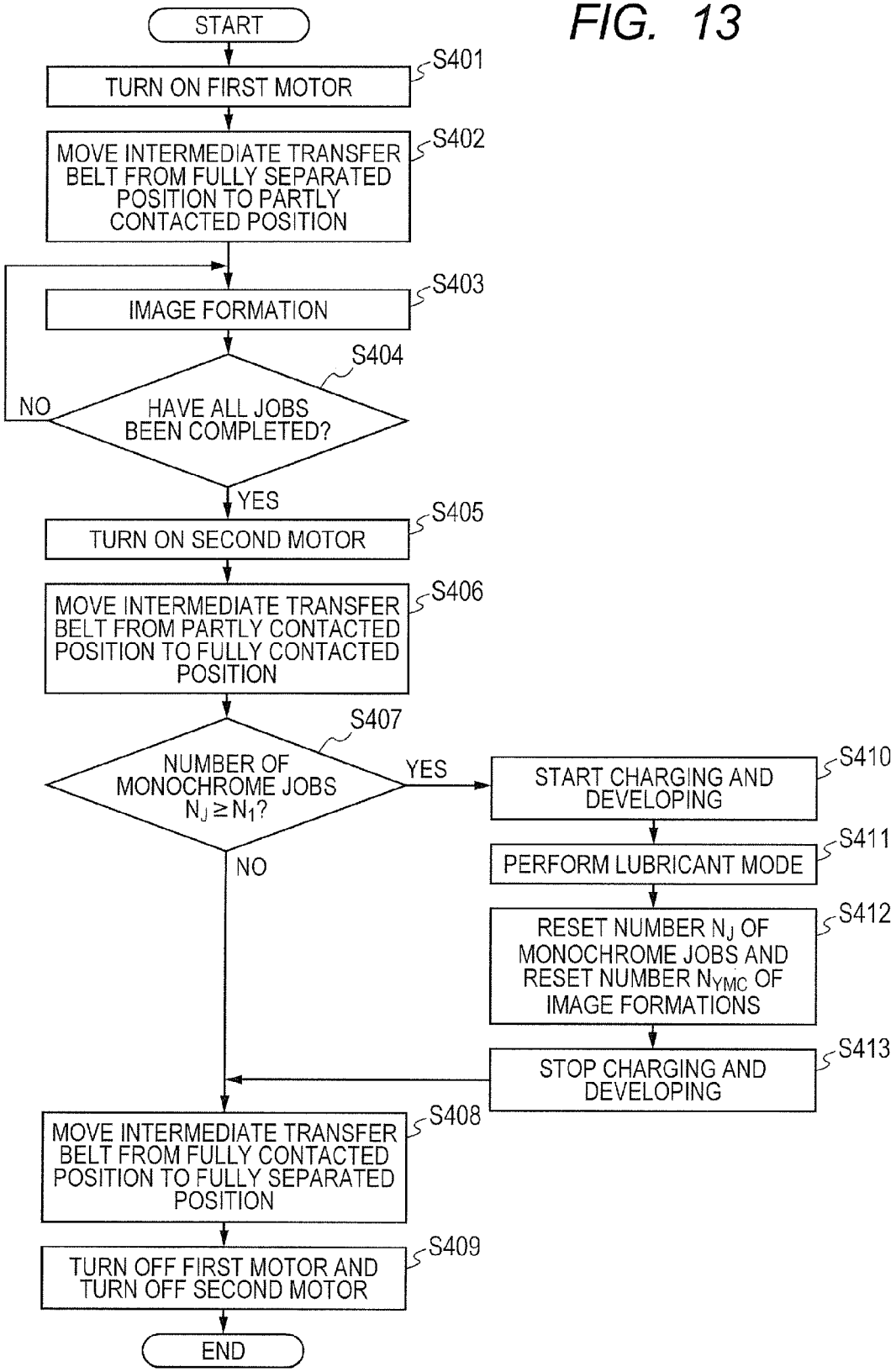
FIG. 13 is a flowchart illustrating control of the lubricant mode when a monochrome mode according to the fourth embodiment is performed.

A fourth embodiment of the present invention will be described with reference to FIG. 12 and FIG. 13 while referring to FIGS. 1, 2A, 2B, 4A, 4B ,4C and 9. In the above-mentioned third embodiment, whether or not to perform the lubricant mode is determined based on the accumulated used amount of the photosensitive drum 103. In contrast, in the embodiment, whether or not to perform the lubricant mode is determined based on the number of image formations and the number of image forming jobs (number of jobs performed) of the monochrome mode. Here, the number of image formations represents the number of printed sheets. Further, the image forming job represents predetermined image forming processing performed in accordance with an instruction issued by a user or the like, and is, for example, processing for performing 100 sheets of image formation in response to the instruction to form 100 sheets of image. The other configuration and operation are the same as those of the third embodiment, and hence a part different therefrom will be mainly described.

In the embodiment, the control portion 200 stores a number $N_{YMC}$ of image formations performed by the image forming portions 109Y, 109M, and 109C, a number $N_{Bk}$ of image formations performed by the image forming portion 109Bk, and a number $N_J$ of image forming jobs in the monochrome mode (number of monochrome jobs). The number $N_J$ of monochrome jobs corresponds to a drive count of the color photosensitive drums 103Y, 103M, and 103C which are driven when the positional relationship is changed from the partly contacted position to the fully separated position through the fully contacted position after the image forming job in the monochrome mode is completed.

The lubricant mode for supplying the lubricant to the drum cleaning blade 108 is performed when the numbers $N_{YMC}$ and $N_{Bk}$ of image formations have reached a predetermined threshold value $N_0$ or when the number $N_J$ of monochrome jobs has reached a predetermined threshold value $N_1$. When the number $N_{YMC}$ of image formations has reached the threshold value $N_0$ or when the number $N_J$ of monochrome jobs has reached the threshold value $N_1$, the lubricant is supplied to the drum cleaning blades 108Y, 108M, and 108C. On the other hand, when the number $N_{Bk}$ of image formations has reached the threshold value $N_0$, the lubricant is supplied to the drum cleaning blade 108Bk. Note that, in the embodiment, the threshold value $N_0$ of the number of image formations is set to 200 sheets, and the threshold value $N_1$ of the number of monochrome jobs is set to 500 times.

Note that, also in the fourth embodiment, in the same manner as in the third embodiment, the toner band formed on the photosensitive drum 103, which is not used for the image formation, is supplied to the drum cleaning blade 108 as the lubricant in the lubricant mode.

Now, the lubricant supply to the drum cleaning blades 108Y, 108M, and 108C will be described for the full-color mode and the monochrome mode separately. First, the lubricant mode to be performed at the time of the image formation in the full-color mode will be described with reference to FIG. 12.

[Full-color Mode]

In the full-color mode, the control portion 200 receives an image forming job, starts to drive the first motor 201 and the second motor 202 (S301), and moves the intermediate transfer belt 101 from the fully separated position to the fully contacted position (S302). Then, the control portion 200 performs the full-color image formation (S303), and then determines whether or not the number $N_{YMC}$ of image formations of the image forming portions 109Y, 109M, and 109C has reached the threshold value $N_0$ (S304).

When the number $N_{ymc}$ of image formations is smaller than the threshold value $N_0$ (NO in S304), the control portion 200 confirms whether or not all the jobs have been completed (S305). When the number $N_{YMC}$ of image formations has reached the threshold value $N_0$ (YES in S304), the control portion 200 performs the lubricant mode for supplying the toner band to the drum cleaning blades 108Y, 108M, and 108C (S308). After performing the lubricant mode, the control portion 200 resets the number $N_{YMC}$ of image formations and the number $N_J$ of monochrome jobs (S309), and proceeds to Step S305.

When there is a job left in Step S305 (NO in S305), the control portion 200 returns to Step S303 to restart the image formation. When all the jobs have been completed (YES in S305), the control portion 200 moves the intermediate transfer belt 101 from the fully contacted position to the fully separated position (S306). Then, the control portion 200 stops the first motor 201 and the second motor 202 (S307).

[Monochrome Mode]

Next, the lubricant mode to be performed at the time of the image formation in the monochrome mode will be described with reference to FIG. 13. In the monochrome mode, the control portion 200 receives an image forming job, starts to drive the first motor 201 (S401), and moves the intermediate transfer belt 101 from the fully separated position to the partly contacted position (S402). Then, the control portion 200 performs the monochrome image formation (S403), and confirms whether or not all the jobs have been completed (S404). When there is a job left (NO in S404), the control portion 200 returns to Step S403 to restart the image formation. When all the jobs have been completed (YES in S404), the control portion 200 starts to drive the second motor 202 (S405), and moves the intermediate transfer belt 101 from the partly contacted position to the fully contacted position in the state in which the photosensitive drums 103Y, 103M, and 103C are rotationally driven (S406). After the movement, the control portion 200 determines whether or not the number $N_J$ of monochrome jobs has reached the threshold value $N_1$ (has become equal to or larger than the threshold value) (S407).

When the number $N_J$ of monochrome jobs is smaller than the threshold value $N_1$ (NO in S407), the control portion 200 moves the intermediate transfer belt 101 from the fully contacted position to the fully separated position (S408), and stops the first motor 201 and the second motor 202 (S409). On the other hand, when the number $N_J$ of monochrome jobs has reached the threshold value $N_1$ (YES in S407), the control portion 200 starts the charging and the developing of the image forming portions 109Y, 109M, and 109C (S410). Then, the control portion 200 performs the lubricant mode for supplying the toner band to the drum cleaning blades 108Y, 108M, and 108C (S411). After performing the lubricant mode, the control portion 200 resets the number $N_J$ of monochrome jobs and the number $N_{YMC}$ of image formations (S412), stops the charging and the developing of the image forming portions 109Y, 109M, and 109C (S413), and proceeds to Step S408.

The lubricant supply to the drum cleaning blades 108Y, 108M, and 108C is described above, but the lubricant supply to the drum cleaning blade 108Bk is performed in the same manner. In other words, the lubricant mode for supplying the toner band to the drum cleaning blade 108Bk may be performed by determining whether or not the number $N_{Bk}$ of image formations has reached the threshold value $N_0$ at the time of the full-color mode and at the time of the monochrome mode in the same manner as in the above-mentioned case.

In the embodiment, as described above, the lubricant mode is performed based on the number of image formations and the number of monochrome jobs. Therefore, it is possible to suppress the occurrence of the blade turn-up. In particular, even when the positional relationship of the intermediate transfer belt 101 and the respective photosensitive drums 103 is changed over in order while the intermediate transfer belt 101 and the contact-separation mechanism 203 are driven in common as in the embodiment, it is possible to suppress the occurrence of the blade turn-up. In other words, in the embodiment, in association with the performance of the monochrome mode, the color photosensitive drum is driven without forming the toner image. In this case, the blade turn-up easily occurs because the toner or the external additive is not sufficiently supplied to the color drum cleaning blades 108Y, 108M, and 108C. Therefore, in the embodiment, the number of monochrome jobs is also counted, and when the predetermined threshold value is reached, the lubricant mode for supplying the lubricant to the color drum cleaning blades 108Y, 108M, and 108C is performed irrespective of the number of image formations. Therefore, it is possible to suppress the occurrence of the blade turn-up at the color drum cleaning blades.

Further, in the embodiment, the number of image formations and the number of monochrome jobs are each counted. However, as described above, a friction at the rubbed portion between the drum and the blade easily increases when the color photosensitive drums are used in the monochrome mode. Therefore, the number of jobs performed in the monochrome mode (number of monochrome jobs) may be counted (without the number of image formations being counted), and when the number of monochrome jobs becomes equal to or larger than a predetermined threshold value, the lubricant mode may be performed by the color image forming portion.

<Other Embodiment>

The description of each of the above-mentioned embodiments is directed to the case where the drum cleaning blade is used as the cleaning unit configured to rub and clean a surface of the photosensitive drum. However, the present invention may be applied even when, for example, a cleaning brush is used as the cleaning unit. In other words, also in the case of the brush, abrasion may occur due to shortage of the lubricant, thereby lowering cleaning performance. Accordingly, by performing the lubricant mode as described above, it is possible to suppress the lowering of the cleaning performance.

Further, the description of each of the above-mentioned embodiments is directed to the configuration in which the toner band is formed on the photosensitive drum 103 by the same method as that employed at the time of the normal image formation, and is supplied to the drum cleaning blade 108 as the lubricant. However, in the lubricant mode, the toner band may be formed on the photosensitive drum 103 by a method different from that employed at the time of the normal image formation.

For example, there is a method of developing the toner by using a potential difference between the developing sleeve 106S and the photosensitive drum 103 instead of using the charging roller 104 to charge the photosensitive drum 103 and using the exposure device 105 to write the electrostatic image to the photosensitive drum 103. In the case of this method, the exposure device 105 is not used, and hence the toner band can be formed only across the entire developing width unlike the normal image formation. However, the charging performed by the charging roller 104 is not used, and hence discharge deterioration of the photosensitive drum 103 is suppressed, which can extend the life of the photosensitive drum 103. Further, this method is particularly effective for the lubricant supply to the drum cleaning blades 108Y, 108M, and 108C performed at the time of the monochrome image formation.

Further, DC charging for applying a DC voltage to the charging roller 104 may be used for a charging method for the photosensitive drum 103, but AC charging for applying an oscillation voltage obtained by superimposing an AC voltage on a DC voltage may also be used. The AC charging is advantageous in that a surface potential of the photosensitive drum 103 has high convergence, but unevenness may occur in the image unless discharge current control for determining an amplitude of the AC voltage is performed. However, in the lubricant supply to the drum cleaning blades 108Y, 108M, and 108C, it is important to supply the toner band serving as the lubricant, and hence it is not necessary to perform the discharge current control.

Accordingly, in the case of using the AC charging, the discharge current control is performed at the time of the normal image formation, but is not performed in the lubricant mode. As a result, the downtime involved in the starting with a high voltage can be shortened.

In addition, in each of the above-mentioned embodiments, the configuration for supplying the toner band formed on the photosensitive drum 103 to the drum cleaning blade 108 as the lubricant is described as the lubricant supply unit. However, a lubricant supply portion may be separately provided as the lubricant supply unit, and a powder lubricant or a liquid lubricant other than the toner may be used.

In the present invention, with the configuration in which a common drive source is used to rotate the intermediate transfer member and to drive the contact-separation mechanism, when the positional relationship passes through the fully contacted position in association with the performance of the second mode, the first image bearing member which is not used in the second mode is rotationally driven. Therefore, it is possible to inhibit the first image bearing member from rubbing the intermediate transfer member rotating in association with the driving of the contact-separation mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-182009, filed Sep. 3, 2013, which is hereby incorporated by reference herein in its entirety.

What is claimed is:

1. An image forming apparatus, comprising:

a first image bearing member to be rotationally driven;

a second image bearing member to be rotationally driven;

a first toner image forming portion configured to form a toner image on the first image bearing member;

a second toner image forming portion configured to form a toner image on the second image bearing member;

an intermediate transfer member arranged so as to be brought into contact with and separated from the first image bearing member and the second image bearing member, the intermediate transfer member being configured so that the toner image formed on the first image bearing member and the toner image formed on the second image bearing member are transferred onto the intermediate transfer member;

a contact-separation mechanism configured to be driven so that the first image bearing member and the second image bearing member are brought into contact with and separated from the intermediate transfer member, the contact-separation mechanism being configured to be driven to move to a fully separated position in which the first image bearing member and the second image bearing member are separated from the intermediate transfer member, a partly contacted position in which the first image bearing member is separated from the intermediate transfer member and the second image bearing member is in contact with the intermediate transfer member, and a fully contacted position in which the first image bearing member and the second image bearing member are in contact with the intermediate transfer member in order as listed a common drive source configured to drive the intermediate transfer member and the contact-separation mechanism separately;

a connection-disconnection device configured to connect and disconnect a drive transmission from the common drive source to the contact-separation mechanism; and a control portion configured to control a position of the contact-separation mechanism, wherein the control portion locates the contact-separation mechanism in the fully contacted position when a first mode for forming the toner image by both of the first image bearing member and the second image bearing member is performed, wherein the control portion stops drive to the first image bearing member and locates the contact-separation mechanism in the partly contacted position when a second mode for forming the toner image by only the second image bearing member is performed, and wherein the control portion rotationally drives the first image bearing member when the contact-separation mechanism is moved to the fully contacted position in association with a performance of the second mode.

2. An image forming apparatus according to claim 1, wherein the control portion controls the contact-separation mechanism to move the contact-separation mechanism to the fully separated position when image formation is not performed, and wherein the control portion rotationally drives the first image bearing member while the contact-separation mechanism is passing through to the fully separated position in association with a completion of the second mode.

3. An image forming apparatus according to claim 1, wherein the second image bearing member is rotationally driven by the common drive source.

4. An image forming apparatus according to claim 1, further comprising:

a cleaning device configured to rub and clean a surface of the first image bearing member; and a supply device configured to supply a lubricant between the first image bearing member and the cleaning device, wherein the control portion causes the supply device to supply the lubricant based on an accumulated used amount of the first image bearing member, the accumulated used amount including an accumulated used amount of the first image bearing member which is driven when the contact-separation mechanism passes through the fully contacted position.

5. An image forming apparatus according to claim 4, wherein the accumulated used amount of the first image bearing member comprises an accumulated rotation amount of the first image bearing member.

6. An image forming apparatus according to claim 4, wherein the first toner image forming portion comprises a charging member configured to charge the surface of the first image bearing member, and wherein the control portion weights calculation of at least one of an accumulated used amount obtained when the surface of the first image bearing member is not charged and an accumulated used amount obtained when the surface of the first image bearing member is charged so that a calculation result of the accumulated used amount obtained when the surface of the first image bearing member is not charged becomes smaller than a calculation result of the accumulated used amount obtained when the surface of the first image bearing member is charged, assuming that an actual accumulated used amount when the surface of the first image bearing member is not charged is the same as an actual accumulated used amount when the surface of the first image bearing member is charged, and the control portion sets a total sum of both the calculation result of the accumulated used amount obtained when the surface of the first image bearing member is not charged and the calculation result of the accumulated used amount obtained when the surface of the first image bearing member is charged as the accumulated used amount of the first image bearing member.

7. An image forming apparatus according to claim 4, wherein the supply device supplies, as the lubricant, the toner image formed by the first toner image forming portion between the first image bearing member and the cleaning device.

8. An image forming apparatus according to claim 4, wherein the cleaning device comprises a cleaning blade formed of an elastic member.

9. An image forming apparatus according to claim 1, further comprising:

a cleaning device configured to rub and clean a surface of the first image bearing member; and a supply device configured to supply a lubricant between the first image bearing member and the cleaning device, wherein the control portion causes the supply device to supply the lubricant when a number of times that the contact-separation mechanism passes through the fully contacted position in association with the performance of the second mode becomes equal to or larger than a predetermined threshold value.

10. An image forming apparatus according to claim 1, wherein the control portion changes over the contact-separation mechanism to the fully separated position when the toner image is not formed.

11. An image forming apparatus, comprising:

a first image bearing member to be rotationally driven;

a second image bearing member to be rotationally driven;

a first toner image forming portion configured to form a toner image on the first image bearing member;

a second toner image forming portion configured to form a toner image on the second image bearing member;

an intermediate transfer member arranged so as to be brought into contact with and separated from the first image bearing member and the second image bearing member, the intermediate transfer member being configured so that the toner image formed on the first image bearing member and the toner image formed on the second image bearing member are transferred onto the intermediate transfer member;

a contact-separation mechanism configured to be driven so that the first image bearing member and the second image bearing member are brought into contact with and separated from the intermediate transfer member, the contact-separation mechanism being configured to be driven to move to a fully separated position in which the first image bearing member and the second image bearing member are separated from the intermediate transfer member, a fully contacted position in which the first image bearing member and the second image bearing member are in contact with the intermediate transfer member, and a partly contacted position in which the first image bearing member is separated from the intermediate transfer member and the second image bearing member is in contact with the intermediate transfer member in order as listed;

a common drive source configured to drive the intermediate transfer member and the contact-separation mechanism separately;

a connection-disconnection device configured to connect and disconnect a drive transmission from the common drive source to the contact-separation mechanism; and a control portion configured to control a position of the contact-separation mechanism, wherein the control portion locates the contact-separation mechanism in the fully contacted position when a first mode for forming the toner image by both of the first image bearing member and the second image bearing member is performed, wherein the control portion stops drive to the first image bearing member and locates the contact-separation mechanism in the partly contacted position when a second mode for forming the toner image by only the second image bearing member is performed, and wherein the control portion rotationally drives the first image bearing member when the contact-separation mechanism is moved to the fully contacted position in association with a performance of the second mode.

12. An image forming apparatus according to claim 11, wherein the control portion controls the contact-separation mechanism to move the contact-separation mechanism to the fully separated position when an image formation is not performed, and wherein the control portion rotationally drives the first image bearing member while the contact-separation mechanism is passing through the partly contacted position in association with a start of the second mode.

13. An image forming apparatus according to claim 11, wherein the second image bearing member is rotationally driven by the common drive source.

14. An image forming apparatus according to claim 11, further comprising:

a cleaning device configured to rub and clean a surface of the first image bearing member; and a supply device configured to supply a lubricant between the first image bearing member and the cleaning device, wherein the control portion causes the supply device to supply the lubricant based on an accumulated used amount of the first image bearing member, the accumulated used amount including an accumulated used amount of the first image bearing member which is driven when the contact-separation mechanism passes through the fully contacted position.

15. An image forming apparatus according to claim 14, wherein the accumulated used amount of the first image bearing member comprises an accumulated rotation amount of the first image bearing member.

16. An image forming apparatus according to claim 14, wherein the first toner image forming portion comprises a charging member configured to charge the surface of the first image bearing member, and wherein the control portion weights calculation of at least one of an accumulated used amount obtained when the surface of the first image bearing member is not charged and an accumulated used amount obtained when the surface of the first image bearing member is charged so that a calculation result of the accumulated used amount obtained when the surface of the first image bearing member is not charged becomes smaller than a calculation result of the accumulated used amount obtained when the surface of the first image bearing member is charged, assuming that an actual accumulated used amount when the surface of the first image bearing member is not charged is the same as an actual accumulated used amount when the surface of the first image bearing member is charged, and the control portion sets a total sum of both the calculation result of the accumulated used amount obtained when the surface of the first image bearing member is not charged and the calculation result of the accumulated used amount obtained when the surface of the first image bearing member is charged as the accumulated used amount of the first image bearing member.

17. An image forming apparatus according to claim 14, wherein the supply device supplies, as the lubricant, the toner image formed by the first toner image forming portion between the first image bearing member and the cleaning device.

18. An image forming apparatus according to claim 14, wherein the cleaning device comprises a cleaning blade formed of an elastic member.

19. An image forming apparatus according to claim 11, further comprising:

a cleaning device configured to rub and clean a surface of the first image bearing member; and a supply device configured to supply a lubricant between the first image bearing member and the cleaning device, wherein the control portion causes the supply device to supply the lubricant when a number of times that the contact-separation mechanism passes through the fully contacted position in association with the performance of the second mode becomes equal to or larger than a predetermined threshold value.

20. An image forming apparatus according to claim 11, wherein the control portion changes over the contact-separation mechanism to the fully separated position when the toner image is not formed.

* * * * *